US007884537B2

(12) United States Patent
Sekiya

(10) Patent No.: US 7,884,537 B2
(45) Date of Patent: Feb. 8, 2011

(54) PATTERN SUBSTRATE INCLUDING CONDUCTIVE PATTERN OF OVERLAPPING CIRCULAR PATTERNS DISPOSED ON SUBSTRATE

(75) Inventor: Takuro Sekiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

(21) Appl. No.: 12/029,967

(22) Filed: Feb. 12, 2008

(65) Prior Publication Data

US 2008/0138570 A1 Jun. 12, 2008

Related U.S. Application Data

(63) Continuation of application No. 11/238,428, filed on Sep. 29, 2005, now Pat. No. 7,355,335, which is a continuation-in-part of application No. 09/793,249, filed on Feb. 26, 2001, now Pat. No. 6,992,433.

(30) Foreign Application Priority Data

Feb. 28, 2000 (JP) ..... 2000-051102
Nov. 24, 2000 (JP) ..... 2000-358111

(51) Int. Cl.
*H01J 63/04* (2006.01)

(52) U.S. Cl. ..... 313/495

(58) Field of Classification Search ..... 313/309–310, 313/495–497
See application file for complete search history.

(56) References Cited

U.S. PATENT DOCUMENTS 4,511,802 A 4/1985 Teraoka
4,790,902 A 12/1988 Wada et al.
4,859,080 A 8/1989 Titus et al.
5,031,172 A 7/1991 Umeda et al.
5,066,883 A 11/1991 Yoshioka et al.
5,205,770 A 4/1993 Lowrey et al.
5,627,111 A 5/1997 Tsukamoto et al.
5,654,607 A 8/1997 Yamaguchi et al.
5,691,242 A 11/1997 Nomi et al.
5,799,080 A 8/1998 Padmanabhan et al.
5,905,335 A 5/1999 Fushimi et al.
5,910,705 A 6/1999 Cathey et al.
5,939,824 A 8/1999 Kishi et al.
5,980,346 A 11/1999 Anderson et al.
5,986,389 A 11/1999 Tsukamoto
5,996,096 A 11/1999 Dell et al.
6,017,259 A 1/2000 Motoi et al.
6,334,803 B1 1/2002 Shibata
6,366,015 B1 4/2002 Shibata
6,437,503 B1 8/2002 Konuma
6,452,328 B1 9/2002 Saito et al.
6,492,769 B1 12/2002 Oda et al.
6,506,440 B2 1/2003 Takahashi et al.
6,579,139 B1 6/2003 Mishima et al.

FOREIGN PATENT DOCUMENTS

JP 6431332 2/1989
JP 1283749 11/1989
JP 2257552 10/1990
JP 9-245622 9/1997
JP 11-120903 4/1999
JP 11-354015 12/1999

*Primary Examiner*—Toan Ton
*Assistant Examiner*—Hana S Featherly
(74) *Attorney, Agent, or Firm*—Cooper & Dunham LLP

(57) ABSTRACT

A pattern substrate including a conductive pattern of overlapping circular patterns disposed on a substrate is provided.

10 Claims, 24 Drawing Sheets

PATTERN SUBSTRATE INCLUDING CONDUCTIVE PATTERN OF OVERLAPPING CIRCULAR PATTERNS DISPOSED ON SUBSTRATE

CROSS-REFERENCE TO RELATED APPLICATIONS

This application is a Rule 1.53(b) Continuation of U.S. Ser. No. 11/238,428, filed Sep. 29, 2005, now U.S. Pat. No. 7,355,335 which in turn is a continuation of Ser. No. 09/793,249 filed Feb. 26, 2001, now U.S. Pat. No. 6,992,433, issued Jan. 31, 2006, the entire contents of each of which are incorporated herein by reference.

BACKGROUND

1. Technical Field of the Invention

This disclosure an electron-emitting device using surface conduction electron-emitting elements, and an image display apparatus in which the electron-emitting device is provided. Further, the present invention relates to an apparatus for production of the electron-emitting device.

2. Description of the Related Art

Conventional electron emission sources for emitting electrons are classified into two major types: hot-cathode devices and cold-cathode devices. The cold-cathode devices include FE (field emission) type, MIM (metal/insulator/metal) type, and surface conduction type. The FE type electron emission devices are, for example, disclosed in "Field Emission" Advance in Electron Physics, vol. 8, p. 89, 1956, by W. P. Dyke & W. W. Dolan and "Physical Properties of Thin-Film Field Emission Cathodes with Molybdenum" J. Appl. Phys., 475248, 1976, by C. A. Spindt. The MIM type electron emission devices are, for example, disclosed in "The Tunnel-Emission Amplifier", J. Appl. Phys., vol. 32, p. 646, 1961, by C. A. Mead. The surface conduction electron emission devices are, for example, disclosed in "Radio Engineering Electron Physics", 1290 (1965) by M. I. Elinson.

Electron-emitting elements of the above surface conduction type utilize the electron emission that is caused by flowing an electric current to a thin film formed with a small area on a substrate, the flow of the current being parallel to the film surface. Hereinafter, these electron-emitting elements and boards or other devices including the electron-emitting elements of this type are called the surface conduction electron-emitting devices.

The surface conduction electron-emitting devices that have been reported in the technical literature include those employing a $SnO_2$ thin film proposed by M. I. Elinson, those employing an Au thin film ("Thin Solid Films", vol. 9, p. 317, 1972, by G. Dittmer), those employing an $In_2O_3/SnO_2$ thin film ("IEEE Trans. ED Conf.", p. 519, 1975, by M. Hartwell and C. G. Fonstad), and those employing a carbon thin film ("Shinku (Vacuum)", vol. 26, No. 1, p. 22, 1983, by Hisashi Arai et al.).

FIG. 31 shows a configuration of a conventional electron-emitting device, which belongs to the above, surface conduction type.

As shown in FIG. 31, in the conventional electron-emitting device, a substrate 1, a pair of opposing electrodes 2 and 3, a conductive thin film 4, and an electron-emitting region 5 are provided. The thin film 4 is formed on the substrate 1 between the electrodes 2 and 3 through sputtering using an electron-emitting material. The thin film 4 is provided with a width "W" that is approximately 0.1 mm. The electrodes 2 and 3 are formed on the substrate 1 to establish electrical connection.

The electrodes 2 and 3 are provided with a distance "L1" that ranges from 0.5 mm to 1.0 mm.

Generally, in the electron-emitting devices, such as that shown in FIG. 31, the electron-emitting region 5 is formed by performing an energizing heat treatment, called "forming", before effecting the electron emission. Specifically, a voltage is applied between the electrode 2 and the electrode 3 to energize the film 4 such that the film 4 is locally destroyed or deformed owing to the Joule heat. The applied voltage causes the electron-emitting region 5 to be held in a state of electrically high resistance, so that the resulting electron-emitting region 5 carries an electron-emitting function.

The state of electrically high resistance of the electron-emitting region 5 is given by a discontinuous state of the film 4 partly having cracks on the surface of the film 4. In the surface conduction electron-emitting devices, a voltage is applied to the high-resistance, discontinuous-state film 4 by using the electrodes 2 and 3 to flow the current to the surface of the film 4, so that the electrons are emitting from the electron-emitting region 5.

The surface conduction electron-emitting devices as mentioned above have the advantageous features that they have a simple structure, they are easy to manufacture, and a large number of electron-emitting elements can be easily arranged in a relatively large area of the thin film. Currently, electron beam sources or image display devices that utilize the surface conduction electron-emitting devices are under development.

For example, Japanese Laid-Open Patent Application Nos. 64-31332, 1-283749 and 2-257552 disclose an electron beam source in which a plurality of the surface conduction electron-emitting devices are arrayed in a matrix formation, and an image display device in which the surface conduction electron-emitting device is provided as the electron beam source.

Further, U.S. Pat. No. 5,066,883 discloses a surface conduction electron-emitting device for use in an image display device. In the image display device of the above document, the surface conduction electron-emitting device is provided as the electron beam source and a target of a fluorescent material is provided to emit a visible light from the portion of the target where an electron beam from the electron beam source hits.

However, a conventional production method for the surface conduction electron-emitting devices, such as those disclosed in the above documents, uses the vapor deposition method and the photolithographic etching method heavily. Hence, in the conventional production method, there are the problems that it requires a large number of manufacturing processes in order to arrange electron-emitting elements in a relatively large area of the thin film, and that the production cost is considerably increased.

In order to overcome the above problems, another production method for the surface conduction electron-emitting devices has been proposed. This production method uses an ink jet drop application device which applies drops of a source material to the substrate to form a conductive thin film in which the surface conduction electron-emitting devices are arranged. For example, U.S. Pat. Nos. 3,060,429, 3,298,030, 3,596,275, 3,416,153, 3,747,129 and 5,729,257 disclose such ink jet drop application devices. The above-mentioned production method makes it possible to arrange the electron-emitting elements in a relatively large area of the thin film without using the vapor deposition method or the photolithographic etching method. The above-mentioned production method has a potential that lowers the manufacturing cost and achieves good yields.

However, in the application of drops of the source material to the substrate in order to form the conductive thin film, which differs from the application of ink drops to the paper in the known ink jet printing, the problems, such as drop application conditions, drop forming conditions and substrate handling conditions, remain unresolved.

Further, in the above-mentioned production method using the ink jet drop application device, when producing the electron-emitting device, the ink jet drop application device applies the drops of the source material to the substrate and the production apparatus forms the conductive thin film in which the surface conduction electron-emitting devices are arranged. In the case of the ink jet printing, the paper can be easily transported to the image forming position where the discharge head is provided. Unlike the ink jet printing, it is necessary that the substrate is suitably attached to or removed from the production apparatus and accurately transported, and the problems of the substrate handling that are specific to the above production method remains.

SUMMARY

In an aspect of this disclosure, there is provided an electron-emitting device production apparatus that can easily produce the electron-emitting device with a simple structure and achieve high-accuracy, low-cost production of the electron-emitting device including the surface conduction electron-emitting elements without causing the problems of the substrate handling.

In another aspect of this disclosure, there is provided an electron-emitting device which provides high-accuracy, low-cost production for the production apparatus and enables safe, accurate formation of the surface conduction electron-emitting elements without causing the problems of the substrate handling.

In another aspect of this disclosure, there is provided an image display apparatus that includes the electron-emitting device, the electron-emitting device providing high-accuracy, low-cost production for the production apparatus and enabling safe, accurate formation of the surface conduction electron-emitting elements without causing the problems of the substrate handling.

An exemplary embodiment includes a production apparatus for producing an electron-emitting device, the electron-emitting device including a substrate, a plurality of pairs of opposing electrodes disposed on the substrate, a conductive thin film disposed on the substrate, and an electron-emitting region spaced apart from the opposing electrodes of each of the electrode pairs, the electron-emitting region being formed in the conductive thin film, the production apparatus comprising: a discharge head which is disposed at a location facing the substrate, the discharge head having a discharge surface for discharging drops of a source material of the conductive thin film to the substrate; and a head control unit which controls the discharge head in accordance with dot pattern information, so that a plurality of surface conduction electron-emitting elements are formed in the conductive thin film through a pattern of dots produced by discharging the drops to the substrate, wherein the production apparatus is configured to have an effective area in which the discharge head is capable of discharging the drops to the substrate, and the effective area is larger than an entire region that covers the electron-emitting elements on the substrate.

In another aspect of this disclosure, there is provided a production apparatus for producing an electron-emitting device, the electron-emitting device including a substrate, a plurality of pairs of opposing electrodes disposed on the substrate, a conductive thin film disposed on the substrate, and an electron-emitting region spaced apart from the opposing electrodes of each of the electrode pairs, the electron-emitting region being formed in the conductive thin film, the production apparatus comprising: a substrate holding unit which holds the substrate; a discharge head which is disposed at a location facing the substrate, the discharge head having a discharge surface for discharging drops of a source material of the conductive thin film to the substrate; a signal transmission unit which transmits a signal indicative of dot pattern information; and a head control unit which controls the discharge head in accordance with the dot pattern information of the signal supplied by the signal transmission unit, so that a plurality of surface conduction electron-emitting elements are formed in the conductive thin film through a pattern of dots produced by discharging the drops to the substrate, wherein the substrate has sides in two orthogonal first directions, the substrate holding unit holds the substrate at a controlled position with respect to the discharge surface of the discharge head, the discharge head is disposed such that a distance between the discharge surface and the electron-emitting region is maintained at a constant value, and, during the formation of the electron-emitting elements, the discharge head and the substrate are moved relative to each other in two orthogonal second directions that are parallel to the first directions of the substrate.

In another aspect of this disclosure, there is provided a production apparatus for producing an electron-emitting device, the electron-emitting device including a substrate, a plurality of pairs of opposing electrodes disposed on the substrate, a conductive thin film disposed on the substrate, and an electron-emitting region spaced apart from the opposing electrodes of each of the electrode pairs, the electron-emitting region being formed in the conductive thin film, the production apparatus comprising: a substrate holding unit which holds the substrate; a discharge head which is disposed at a location facing the substrate, the discharge head having a discharge surface for discharging drops of a source material of the conductive thin film to the substrate; a head carriage which transports the discharge head in two orthogonal directions of the substrate; a signal transmission unit which transmits a signal indicative of dot pattern information; and a head control unit which controls the discharge head in accordance with the dot pattern information of the signal supplied by the signal transmission unit, so that a plurality of surface conduction electron-emitting elements are formed in the conductive thin film through a pattern of dots produced by discharging the drops to the substrate, wherein the substrate holding unit holds the substrate at a controlled horizontal position under the discharge surface of the discharge head, and the discharge head is disposed such that a distance between the discharge surface and the electron-emitting region is maintained at a constant value, and the substrate is configured to have a thickness ranging from 4 mm to 15 mm.

In another aspect of this disclosure, there is provided an electron-emitting device comprising: a substrate which has sides in two orthogonal first directions; a plurality of pairs of electrodes which are disposed on the substrate; a conductive thin film which is disposed between each of the plurality of the electrode pairs; and a plurality of surface conduction electron-emitting elements which are disposed in the conductive thin film by discharging drops of a source material of the conductive thin film thereto, each electron-emitting element spaced apart from the opposing electrodes of one of the plurality of the electrode pairs, wherein the surface conduction electron-emitting elements are arrayed in a matrix formation, the matrix of the electron-emitting elements having rows and columns in two orthogonal second directions, the electron-emitting elements being disposed such that the second directions of the matrix are parallel to the first directions of the substrate.

In another aspect of this disclosure, there is provided an image display apparatus comprising: an electron-emitting device; and a face plate which is provided to face the electro-emitting device and having a fluorescent medium that visualizes an image in response to electrons emitted by the electron-emitting device, the electron-emitting device comprising: a substrate which has sides in two orthogonal first directions; a plurality of pairs of electrodes which are disposed on the substrate; a conductive thin film disposed between each of the plurality of the electrode pairs; and a plurality of surface conduction electron-emitting elements which are disposed in the conductive thin film by discharging drops of a source material of the conductive thin film thereto, each electron-emitting element spaced apart from the opposing electrodes of one of the plurality of the electrode pairs, wherein the surface conduction electron-emitting elements are arrayed in a matrix formation, the matrix of the electron-emitting elements having rows and columns in two orthogonal second directions, the electron-emitting elements being disposed such that the second directions of the rows and columns of the matrix are parallel to the first directions of the sides of the substrate.

In another aspect of this disclosure, there is provided an image display apparatus comprising: an electron-emitting device; and a face plate which is provided to face the electro-emitting device and having a fluorescent medium that visualizes an image in response to electrons emitted by the electron-emitting device, the electron-emitting device comprising: a substrate which has sides in two orthogonal first directions; a plurality of pairs of electrodes disposed on the substrate; a conductive thin film which is disposed between each of the plurality of the electrode pairs; and a plurality of surface conduction first electron-emitting elements which are disposed in the conductive thin film by discharging drops of a source material of the conductive thin film thereto, each electron-emitting element spaced apart from the opposing electrodes of one of the plurality of the electrode pairs, wherein a device identification pattern, including a plurality of surface conduction second electron-emitting elements, is disposed outside a region of the first electron-emitting elements on the substrate by discharging drops of the source material of the conductive thin film to the substrate, and wherein the image display apparatus is configured to visualize a device identification image in response to electrons emitted from the device identification pattern of the electron-emitting device.

The above-mentioned electron-emitting device production apparatus makes it possible to easily produce the electron-emitting device with a simple structure and achieve high-accuracy, low-cost production of the electron-emitting device including the surface conduction electron-emitting elements without causing the problems of the substrate handling.

The above-mentioned electron-emitting device and the above-mentioned image display apparatus according to the present invention are effective in providing high-accuracy, low-cost production for the production apparatus, and in providing safe, accurate formation of the surface conduction electron-emitting elements without causing the problems of the substrate handling.

BRIEF DESCRIPTION OF THE DRAWINGS

Other aspects, features and advantages will be apparent from the following detailed description when read in conjunction with the accompanying drawings.

DETAILED DESCRIPTION OF PREFERRED EMBODIMENTS

A description will now be provided of preferred embodiments of the present invention with reference to the accompanying drawings.

Figure 1A:
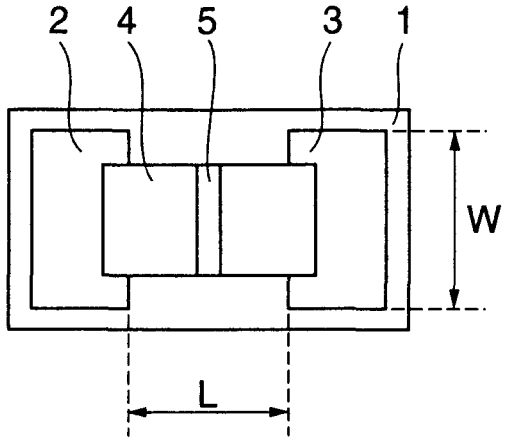
FIG. 1A and FIG. 1B are diagrams showing one embodiment of the electron-emitting device which is produced by the production apparatus of the invention.
Figure 1B:
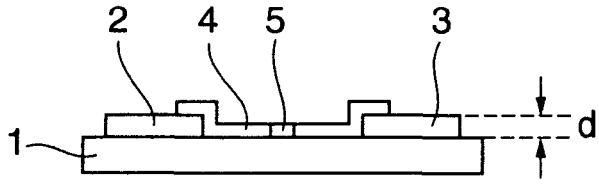

FIG. 1A and FIG. 1B shows one embodiment of the electron-emitting device which is produced by the production apparatus of the present invention. FIG. 1A is a plan view of the electron-emitting device, and FIG. 1B is a cross-sectional view of the electron-emitting device.

For the sake of simplicity of description, the electron-emitting device of the present embodiment is provided with a single surface conduction electron-emitting element as shown in FIG. 1A and FIG. 1B. However, in practical applications, a plurality of surface conduction electron-emitting elements are arrayed in a matrix formation in the electron-emitting device.

As shown in FIG. 1A and FIG. 1B, in the electron-emitting device of the present embodiment, a substrate 1, a pair of opposing electrodes 2 and 3, a conductive thin film 4, and an electron-emitting region 5 are provided. A suitable material of the substrate 1 may be selected from a silica glass, a tempered glass (in which impurities such as Na are reduced), and a glass substrate or a ceramic substrate with a $SiO_2$ deposited surface.

The electrodes 2 and 3 are formed on the substrate 1 to establish electrical connection. A suitable material of the electrodes 2 and 3 may be selected from commonly used conductive materials containing metals or alloys of Ni, Cr, Au, Mo, W, Pt, Ti, Al and Cu, printing conductors containing a glass and metals or metal oxides of Pd, As, Ag, Au, $RuO_2$ and Pd—Ag, transparent conductor materials such as $In_2O_3$—$SnO_2$, and semiconductor materials such as polysilicon.

The electrodes 2 and 3 are spaced apart from each other with a distance "L" that is of the order of $10^3$ Å to $10^2$ μm. A preferred distance L between the electrodes 2 and 3 when the applied voltage is taken into consideration is of the order of 1 to $10^2$ μm. The electrodes 2 and 3 are provided with a width "W" that is of the order of 1 to $10^2$ μm, wherein the electrode resistance and the electron-emitting characteristics are taken into consideration. The electrodes 2 and 3 are provided with a thickness "d" that is of the order of $10^2$ Å to 1 μm.

The configuration of the electron-emitting device of the present invention is not limited to the embodiment of FIG. 1A and FIG. 1B.

Figure 2A:
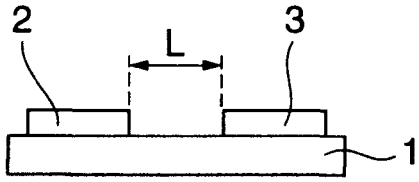
FIG. 2A, FIG. 2B and FIG. 2C are diagrams for explaining a production method for the electron-emitting device of FIG. 1A and FIG. 1B.
Figure 2B:
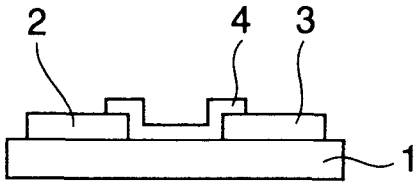
Figure 2C:
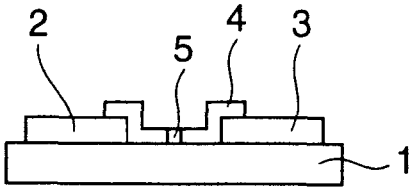

FIG. 2A, FIG. 2B and FIG. 2C are diagrams for explaining a production method for producing the electron-emitting device of FIG. 1A and FIG. 1B.

In order to achieve good electron-emitting characteristics, it is preferred that the conductive thin film 4 is formed into a fine-particle layer containing fine particles. As shown in FIG. 2B, the conductive thin film 4 is disposed between the electrode 2 and the electrode 3. The conductive thin film 4 is provided with a thickness that depends on the electrode coverage condition, the electrode-to-electrode resistance and the forming conditions. A preferred thickness of the conductive thin film 4 is of the order of 10 to 500 Å.

The conductive thin film 4 is provided with an electrical resistance Rs that is of the order of $10^2$ to $10^7\Omega$. The resistance Rs is represented by the formula $Rs=\rho/t$ where ρ is a volume resistivity of a film having a thickness t, a width w and a unit length, and the resistance of the film is assumed to be equal to $R=Rs\ (1/w)$.

As shown in FIG. 2C, the electron-emitting region 5 is spaced apart from the electrodes 2 and 3 and formed in the conductive thin film 4. The electron-emitting region 5 is formed by performing the so-called "forming", before effecting the electron emission. Specifically, a forming voltage is applied between the electrode 2 and the electrode 3 to energize the film 4 such that the film 4 is locally destroyed or deformed owing to the Joule heat. The applied voltage causes the electron-emitting region 5 to be held in a state of electrically high resistance, so that the resulting electron-emitting region 5 carries an electron-emitting function.

The state of electrically high resistance of the electron-emitting region 5 is given by a discontinuous state of the film 4 partly having cracks on the surface of the film 4. In the surface conduction electron-emitting device, a voltage is applied to the high-resistance, discontinuous-state film 4 by using the electrodes 2 and 3 to flow the current to the surface of the film 4, so that the electrons are emitting from the electron-emitting region 5.

A suitable material of the conductive thin film 4 may be selected from metals of Pd, Pt, Ru, Ag, Au, Ti, In, Cu, Cr, Fe, Zn, Sn, Ta, W, Pb and so on, oxides of PdO, $SnO_2$, $In_2O_3$, PbO, $Sb_2O_3$ and so on, borides of $HfB_2$, $ZrB_2$, $LaB_6$, $CeB_6$, $YB_4$, $GdB_4$ and so on, carbides of TiC, XrC, HfC, TaC, SiC, WC and so on, nitrides of TiN, ZrN, HfN and so on, semiconductors of Si, Ge and so on, and carbon.

The fine particles contained in the conductive thin film 4 as the fine-particle layer have a diameter that is of the order of 1 Å to 1 μm. A preferred diameter of the fine particles of the film 4 is of the order of 10 Å to 200 Å.

Figure 3:
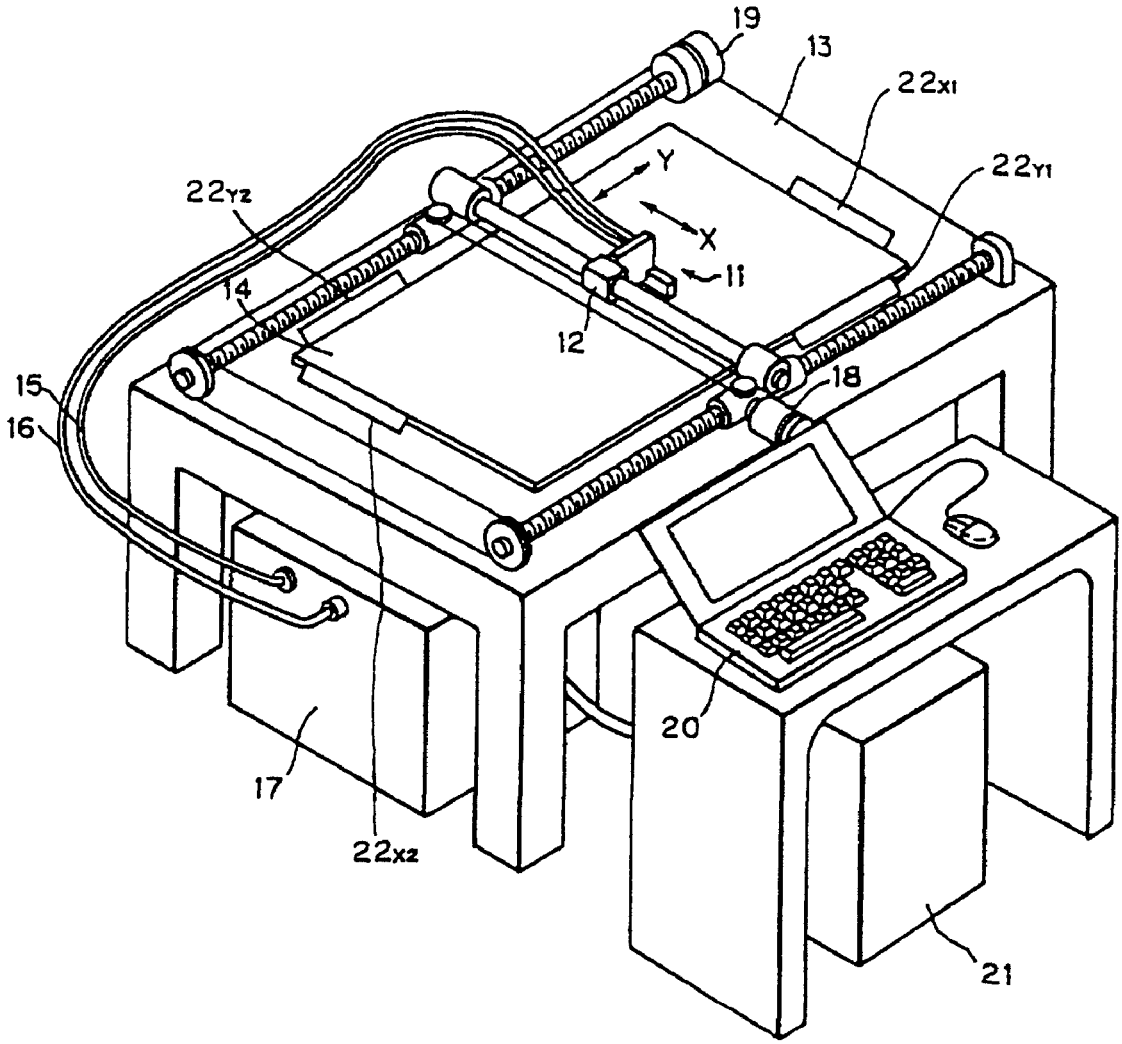
FIG. 3 is a perspective view of one embodiment of the electron-emitting device production apparatus of the invention.

Next, FIG. 3 shows one embodiment of the electron-emitting device production apparatus of the invention.

As shown in FIG. 3, in the production apparatus of the present embodiment, there are provided a discharge head 11, a head carriage 12, a substrate holding base 13, a substrate 14 (which is a base on which the surface conduction electron-emitting elements are formed), a source material supply tube 15 (which supplies a liquid of the source material of the conductive thin film), a signal transmission cable 16, a discharge head control box 17, an X-direction scanning motor 18, a Y-direction scanning motor 19, a computer 20, a control box 21, and a substrate positioning/holding device 22 (which includes the elements $22x_1$, $22x_2$, $22y_1$, and $22y_2$).

In the production apparatus of FIG. 3, the substrate positioning/holding device 22 holds the substrate 14 on the substrate holding base 13. The substrate positioning/holding device 22 includes a rotational position adjustment unit which adjusts a rotational position of the substrate 14. The discharge head 11 is disposed at a location facing the substrate 14 and has a discharge surface for discharging drops of the source material of the conductive thin film downward to the substrate 14. The supply tube 15 supplies the liquid of the source material to the discharge head 11. The signal transmission cable 16 transmits a signal indicative of dot pattern information. The head control box 17 controls the discharge head 11 in accordance with the dot pattern information of the signal supplied by the signal transmission cable 16, so that a plurality of surface conduction electron-emitting elements are formed in the conductive film through a patter of dots produced on the substrate 14 by discharging the drops to the substrate 14.

In the production apparatus of FIG. 3, the respective sides of the substrate 14 are brought into contact with the elements $22x_1$, $22x_2$, $22y_1$ and $22y_2$ of the substrate positioning/holding device 22, and the position of the substrate 14 is finely adjusted by the substrate positioning/holding device 22. The substrate positioning/holding device 22 is connected to the head control box 17, the computer 20 and the control box 21, and a feedback control process is performed so that the production apparatus can determine the carriage positioning information, the fine adjustment information and the drop application position information.

In the embodiment of FIG. 3, the substrate positioning/holding device 22 holds the substrate 14 at a controlled position with respect to the discharge surface of the head 11. The discharge head II is disposed such that a distance between the discharge surface of the head 11 and the electron-emitting region of the substrate 14 is maintained at a constant value. During the formation of the electron-emitting elements, the discharge head 11 is moved relative to the substrate 14 in the two orthogonal directions X and Y by the scanning motors 18 and 19. The directions X and Y of the movement of the discharge head 11 are parallel to the two orthogonal directions of the sides of the substrate 14.

In the embodiment of FIG. 3, the discharge head 11 may be an ink jet head that discharges drops having a weight of several $10^{-9}$ g. A suitable type of the discharge head 11 may be selected from a piezoelectric ink jet system, a thermal bubble jet system and a charge controlled system (or a continuous current system).

In the embodiment of FIG. 3, the production apparatus is configured such that the effective area in which the discharge head 11 is capable of discharging the drops to the substrate 14 is larger than the entire region that covers the electron-emitting elements on the substrate 14.

Figure 4:
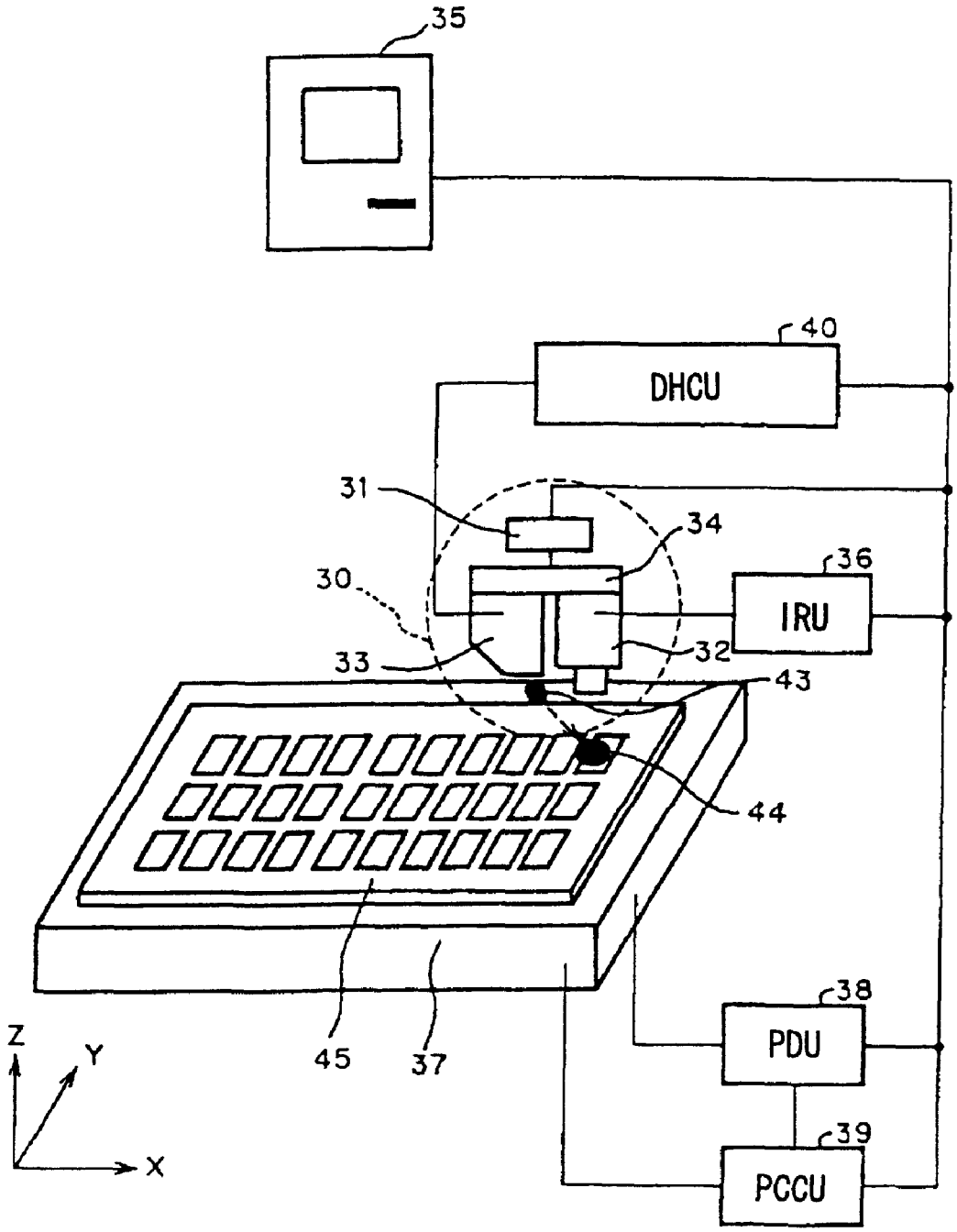
FIG. 4 is a diagram for explaining a discharge head device in another embodiment of the electron-emitting device production apparatus of the invention.

FIG. 4 shows a discharge head device in another embodiment of the electron-emitting device production apparatus of the invention.

As shown in FIG. 4, in the production apparatus of the present embodiment, there are provided a discharge head unit 30, a head alignment control unit 31, a detection optical system 32, a discharge head 33, a head alignment adjusting unit 34, a computer 35, an image recognition unit (IRU) 36, an XY scanning unit 37, a position detecting unit (PDU) 38, a position correction control unit (PCCU) 39, a discharge head control unit (DHCU) 40, and a substrate 45.

Unlike the previous embodiment of FIG. 3, in the present embodiment, the substrate 45 is moved relative to the discharge head 33 in the two orthogonal directions X and Y by the XY scanning unit 37 during the formation of the electron-emitting elements on the substrate 45. The directions X and Y of the movement of the substrate 45 are, respectively, parallel to the two orthogonal directions of the sides of the substrate 45.

In the production apparatus of FIG. 4, the discharge head 33 is disposed at a location facing the substrate 45 and has a discharge surface for discharging drops 43 of the source material of the conductive thin film downward to the substrate 45. The XY scanning unit 37 holds the substrate 45 at a controlled position under the discharge surface of the discharge head 33. The head alignment adjusting unit 34 controls the discharge head 33 so as to adjust a rotational position of the discharge head 33 with respect to the substrate 45 on the XY scanning unit 37. The computer 35 transmits a signal indicative of dot pattern information to the DHCU 40. The DHCU 40 controls the discharge head 33 in accordance with the dot pattern information of the signal supplied by the computer 35, so that a plurality of surface conduction electron-emitting elements are formed in the conductive film through a pattern of dots produced on the substrate 45 by discharging the drops 43 to the substrate 45.

In the production apparatus of FIG. 4, the XY scanning unit 37 holds the substrate 45 at a controlled horizontal position under the discharge surface of the discharge head 33. The discharge head 33 is disposed such that a distance between the discharge surface of the head 33 and the electron-emitting region of the substrate 45 is maintained at a constant value. During the formation of the electron-emitting elements, the substrate 45 is moved relative to the discharge head 33 in the two orthogonal directions X and Y by the XY scanning unit 37. The directions X and Y of the movement of the substrate 45 are, respectively, parallel to the two orthogonal directions of the sides of the substrate 45.

Similar to the previous embodiment of FIG. 3, a suitable type of the discharge head 33 in the present embodiment may be selected from the piezoelectric ink jet system, the heater-based bubble jet system and the charge controlled system.

Figure 5A:
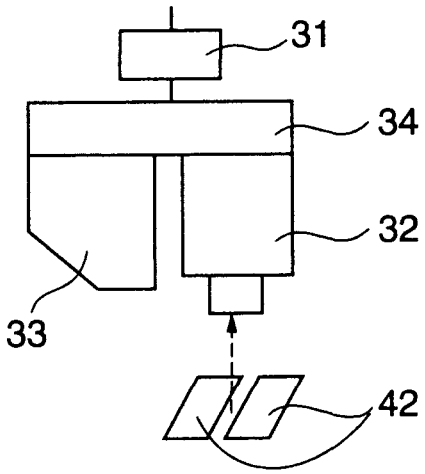
FIG. 5A and FIG. 5B are diagrams showing a discharge head unit in the discharge head device of FIG. 4.
Figure 5B:
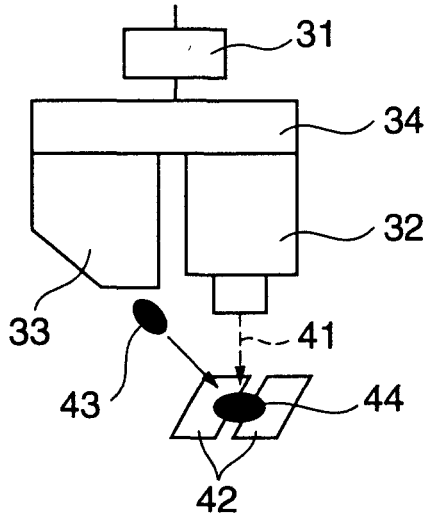

FIG. 5A and FIG. 5B show the discharge head unit 30 in the discharge head device of FIG. 4.

As shown in FIG. 5A and FIG. 5B, in the discharge head unit 30 of the present embodiment, the detection optical system 32 is provided to optically detect image information on the substrate 45. The detection optical system 32 is disposed adjacent to the discharge head 33 such that an optical axis 41 of the detection optical system 32 matches with a drop applied position 44 where the drop 43 discharged from the discharger head 33 hits the substrate. The head alignment control unit 31 and the head alignment adjusting unit 34 provides a fine adjustment of the position of the discharge head 33 relative to the substrate 45. The detection optical system 32 is configured by using a lens and a CCD (charge-coupled device) camera.

In the production apparatus of FIG. 4, the IRU 36 recognizes an image based on the image information detected by the detection optical system 32, and transmits a signal indicative of the recognized image information to the computer 35. Specifically, the IRU 36 of this embodiment is configured by using a precision image recognizer VX-4210 manufactured by Kiense Co. The PDU 38 provides position information of the substrate 45 for the image information recognized by the IRU 36. The PDU 38 may be configured by using a position measuring device or a linear encoder of the XY scanning unit 37. The PCCU 39 provides a position correction of the XY scanning unit 37 based on the position information supplied by the PDU 38 and the image information supplied by the IRU 36. The DHCU 40 controls the discharge head 33 in accordance with the dot pattern information supplied by the computer 35, so that the plurality of the surface conduction electron-emitting elements are formed in the conductive thin film through the pattern of dots produced by discharging the drops 43 to the substrate 45. The conductive thin film is disposed between the opposing electrodes 42 on the substrate 45.

Similar to the previous embodiment of FIG. 3, the production apparatus of FIG. 4 is configured such that the effective area in which the discharge head 33 is capable of discharging the drops 43 to the substrate 45 is larger than the entire region that covers the electron-emitting elements on the substrate 45.

According to the production apparatus of the present embodiment, the substrate 45 has the sides in the two orthogonal directions X and Y, and the surface conduction electron-emitting elements are disposed by discharging the drops 43 to the substrate 45, and the electron-emitting elements are arrayed in a matrix formation, the matrix of the electron-emitting elements having rows and columns in two orthogonal second directions, and the electron-emitting elements are disposed such that the second directions of the matrix are parallel to the directions X and Y of the substrate 45.

In the present embodiment, a suitable source material of the drops 43, which forms the desired conductive thin film, may be selected from one of aqueous solutions containing suitable elements and compounds, and organic solvents. Specifically, appropriate examples of such source material of the drops 43 when forming the conductive thin film from a palladium based compound are aqueous solutions containing any of palladium acetate-ethanolamine (PA-ME), palladium acetate-diethanol (PA-DE), palladium acetate-triethanolamine (PA-TE), palladium acetate-butylethanolamine (PA-BE) and palladium acetate-dimetylethanolamine (PA-DME), or aqueous solutions containing any of palladium-glycine (Pd-Gly), palladium-β-alanine (Pd-β-alanine) and palladium-DL-alanine (Pd-DL-alanine), or a butylacetate solution containing palladium acetate-bis-dipropylamine.

In a conventional production method using an ink jet drop application device, when producing the electron-emitting device, the ink jet drop application device applies the drops of the source material to the substrate and the production apparatus forms the conductive thin film in which the surface conduction electron-emitting elements are provided. In the case of the ink jet printing, the paper can be easily transported to the image forming position where the discharge head is provided. Unlike the ink jet printing, it is necessary that the substrate is suitably attached to and removed from the production apparatus and accurately transported, and the problems of the substrate handling remain unresolved.

One of the above problems is that a conventional ink jet drop application device forms unclear dots on the substrate by applying drops of the source material thereto, and the formation of appropriate electron-emitting elements is not possible.

Experiments have been performed to examine the status of the dot formed on the substrate when the surface roughness of the front surface of the substrate is varied. The following TABLE 1 provides the results of the experiments.

TABLE 1

| Test No. | Substrate Material | Surface Roughness (s) | Dot Forming Status |
|---|---|---|---|
| 1 | silica glass | 0.05 | o |
| 2 | silica glass | 0.1 | o |
| 3 | silica glass | 0.3 | o |
| 4 | silica glass | 0.5 | o |
| 5 | silica glass | 0.8 | x |
| 6 | silica glass | 1.3 | x |
| 7 | silica glass | 2.0 | x |
| 8 | $SiO_2$ alumina | 0.2 | o |
| 9 | $SiO_2$ alumina | 0.5 | o |
| 10 | $SiO_2$ alumina | 0.8 | x |
| 11 | $SiO_2$ alumina | 1.2 | x |

In the experiments, the production apparatus of FIG. 3 is used and the dot forming status when the discharge head discharges the drops to the substrate. The source material of the conductive thin film used in the experiments is an aqueous solution of 2.0 wt % of palladium acetate-triethanolamine (PA-TE). The discharge head used in the experiments is an edge-shooter thermal ink jet head. The nozzle diameter is 28 μm. The size of the heater is 28 μm×130 μl m. The resistance of the heater is 102Ω. The drive voltage of the discharge head is 27 V. The pulse width of the signal is 16 μs. The energy needed to discharge a drop is 43 μJ. The discharge speed of the head is about 8 m/s.

In the above TABLE 1, "o" in the "dot forming status" column indicates that a clear dot was formed on the substrate and the formation of suitable electron-emitting elements was possible, and "x" in the same column indicates that an unclear dot was formed on the substrate and the formation of suitable electron-emitting elements was not possible.

In the above TABLE 1, the surface roughness values are used in the following manner. The larger the surface roughness value, the coarser the surface concerned. Namely, if the roughness of a surface is indicated by a small surface roughness value (e.g., 0.05 s), it means that the surface is relatively smooth and the irregularities of the surface are removed. If the roughness of a surface is indicated by a large surface roughness value (e.g., 2.0 s), it means that the surface is relatively coarse and the irregularities of the surface are left.

From the above test results, it is found out that the problem of the dot forming status can be overcome by setting the surface roughness of the substrate less than the surface roughness level 0.5 s, and that the kind of the substrate material is not related to this problem. In both the cases of silica glass and $SiO_2$ alumina, the front surface of the substrate on which the electron-emitting elements are formed must be ground to the surface roughness level 0.5 s or less. The back surface of the substrate, which is not related to this problem, may be left with a certain degree of the surface roughness. When the manufacturing cost is taken into consideration, the grinding of only the front surface of the substrate will achieve a low-cost production of the electron-emitting devices.

Another problem of the conventional production apparatus is that the back surface of the substrate 14 is liable to sticking to the substrate holding base 13 of the production apparatus during the manufacture of the electron-emitting device. In the worst case, it is difficult to remove the substrate 14 from the substrate holding base 13, when moving the substrate 14, due to the substrate sticking, which may cause the damage to the product or the injury to the operator.

Experiments have been performed to examine the ease of removal of the substrate 14 from the substrate holding base 13 when the surface roughness of the back surface of the substrate is varied. The following TABLE 2 provides the results of the experiments.

TABLE 2

| Test No. | Substrate Material | Surface Roughness (s) | Ease of Removal of Substrate |
|---|---|---|---|
| 1 | silica glass | 0.1 | x |
| 2 | silica glass | 0.5 | x |
| 3 | silica glass | 1.0 | o |
| 4 | silica glass | 1.5 | o |
| 5 | silica glass | 3.0 | o |
| 6 | $SiO_2$ alumina | 0.5 | x |
| 7 | $SiO_2$ alumina | 1.0 | o |
| 8 | $SiO_2$ alumina | 1.5 | o |
| 9 | $SiO_2$ alumina | 3.0 | o |

In the above TABLE 2, "o" in the "ease of removal of substrate" column indicates that the substrate was easily removed from the substrate holding base 13, and "x" in the same column indicates that the substrate was not easily removed from the substrate holding base 13. The substrate holding base 13 is of a stainless steel SUS304, and the surface of the substrate holding base 13 is finished by using a grinding wheel. The bottom surface of the $SiO_2$ alumina substrate is covered with alumina only and no $SiO_2$ is deposited thereon.

From the above test results, it is found out that the problem of the substrate handling (or the substrate sticking) can be overcome by setting the surface roughness of the substrate (the back surface) above 1.0 s, and that the kind of the substrate material is not related to this problem.

Figure 6A:
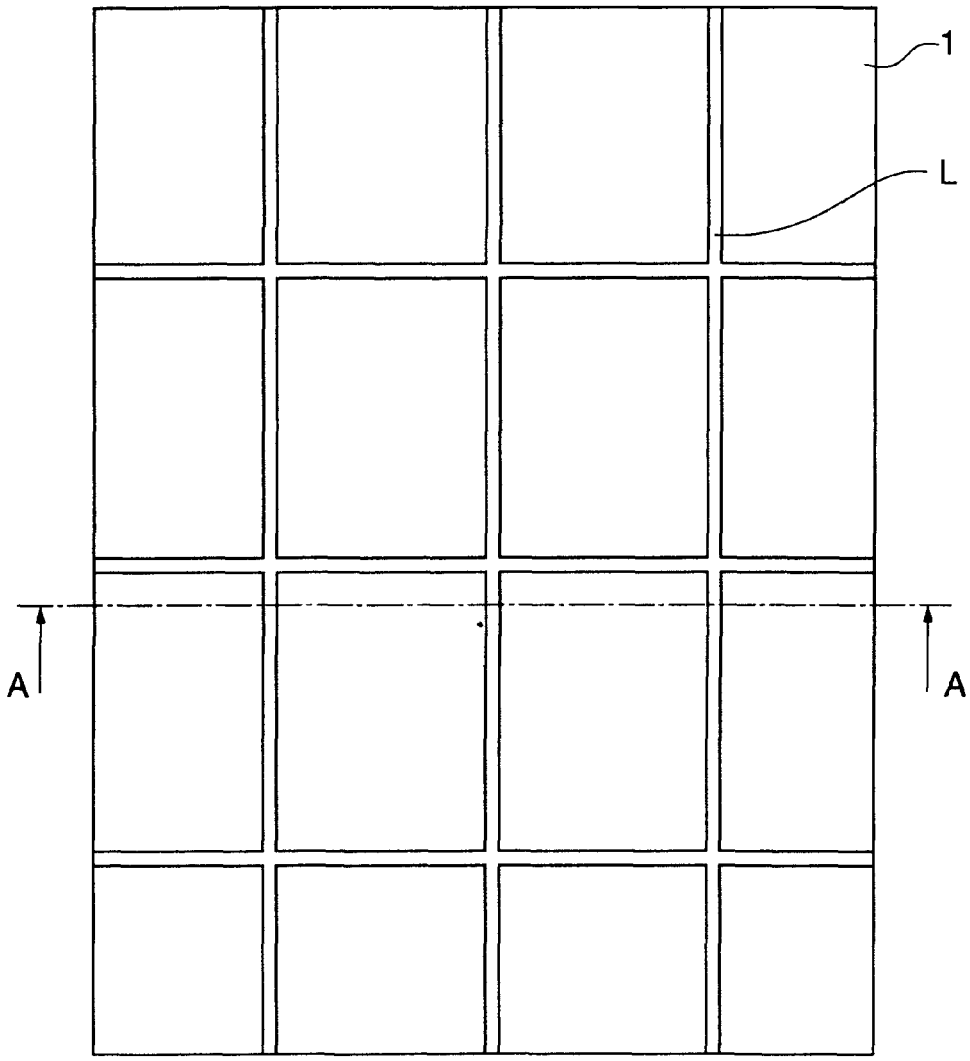
FIG. 6A and FIG. 6B are diagrams showing one embodiment of the substrate that is appropriate for the electron-emitting device of the invention.
Figure 6B:
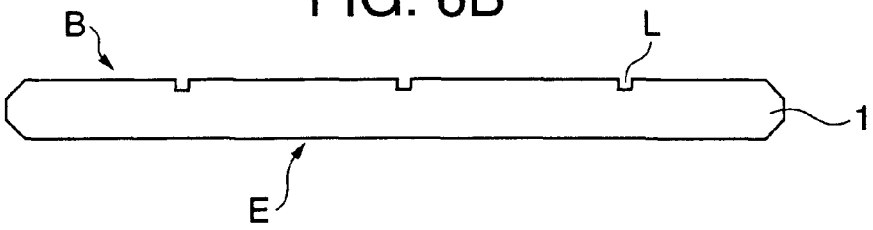

Next, FIG. 6A and FIG. 6B show one embodiment of the substrate that is appropriate for the electron-emitting device of the invention. FIG. 6A is a plan view of the back surface of the substrate 1, and FIG. 6B is a cross-sectional view of the substrate 1 taken along a line A-A in FIG. 6A. In these figures, "B" indicates the back surface of the substrate 1, "E" indicates the front surface of the substrate 1, and "L" indicates a line shaped groove on the back surface.

In the present embodiment, the substrate 1 is provided with the line shaped grooves L on the back surface, in order to overcome the problem of the substrate sticking. In a conventional production apparatus, the substrate on the substrate holding base of the production apparatus may be held in a vacuum condition or the like, and the substrate sticking occurs. If the vacuum condition between the substrate and the substrate holding base is avoided, the occurrence of the substrate sticking can be prevented.

As shown in FIG. 6A and FIG. 6B, the back surface of the substrate 1 is provided with the line shaped grooves L that are arranged in a lattice formation. The vacuum condition between the substrate and the substrate holding base is avoided by the use of the line shaped grooves L in the present embodiment, and the substrate 1 of the present embodiment is effective in overcoming the problem of the substrate sticking.

Figure 7A:
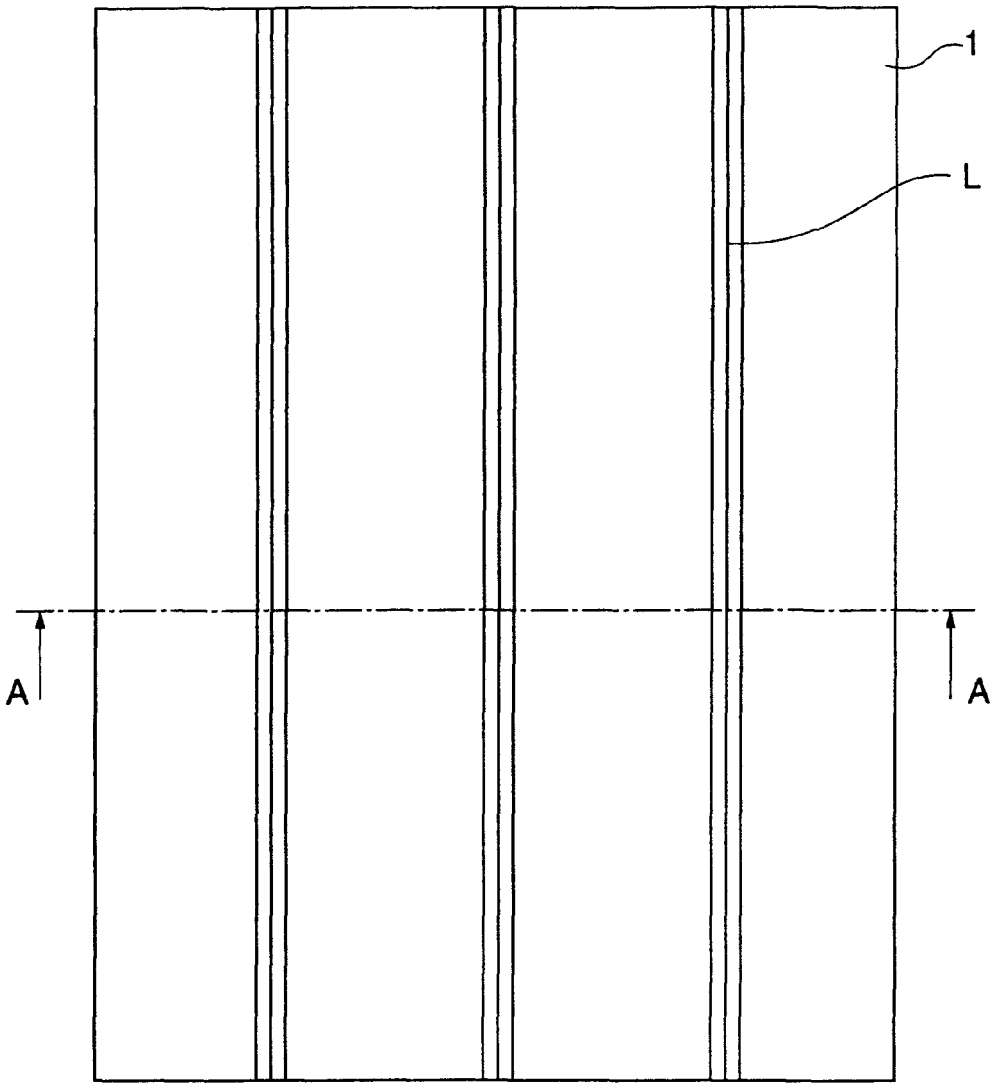
FIG. 7A and FIG. 7B are diagrams showing another embodiment of the substrate that is appropriate for the electron-emitting device of the invention.
Figure 7B:
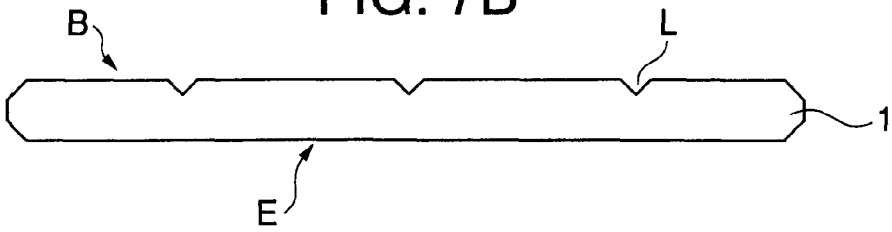

FIG. 7A and FIG. 7B show another embodiment of the substrate that is appropriate for the electron-emitting device of the invention. FIG. 7A is a plan view of the back surface of the substrate 1, and FIG. 7B is a cross-sectional view of the substrate 1 taken along a line A-A in FIG. 7A. In these figures, "B" indicates the back surface of the substrate 1, "E" indicates the front surface of the substrate 1, and "L" indicates a line shaped groove on the back surface.

As shown in FIG. 7A and FIG. 7B, in the present embodiment, the substrate 1 is provided with three line shaped V-grooves L that are arranged in parallel in a straight-line formation. The vacuum condition between the substrate and the substrate holding base is avoided by the use of the line shaped grooves L in the present embodiment, and the substrate 1 of the present embodiment is effective in overcoming the problem of the substrate sticking.

As a related matter, experiments have been performed to examine the ease of removal of the substrate 14 from the substrate holding base 13 when the depth of the line shaped grooves L of the back surface of the substrate relative to the thickness of the substrate is varied. The following TABLE 3 provides the results of the experiments.

TABLE 3

| Thickness t [mm] | Groove Depth d [mm] | Ratio t/d | Evaluation Results |
|---|---|---|---|
| 2 | 0.02 | 100 | x (sticking) |
| 2 | 0.04 | 50 | o |
| 2 | 0.1 | 20 | o |
| 2 | 0.2 | 10 | o |
| 2 | 0.3 | 6.7 | o |
| 2 | 0.4 | 5 | o |
| 2 | 0.5 | 4 | x (damage) |
| 2 | 1 | 2 | x (damage) |
| 4 | 0.04 | 100 | x (sticking) |
| 4 | 0.06 | 67 | x (sticking) |
| 4 | 0.08 | 50 | o |
| 4 | 0.1 | 40 | o |
| 4 | 0.5 | 8 | o |
| 4 | 0.8 | 5 | o |
| 4 | 1 | 4 | x (damage) |
| 4 | 2 | 2 | x (damage) |
| 10 | 0.04 | 250 | x (sticking) |
| 10 | 0.08 | 125 | x (sticking) |
| 10 | 0.2 | 50 | o |
| 10 | 0.5 | 20 | o |
| 10 | 1 | 10 | o |
| 10 | 1.3 | 7.8 | o |
| 10 | 2 | 5 | o |
| 10 | 3 | 3.3 | x (damage) |
| 10 | 5 | 5 | x (damage) |

In the above TABLE 3, "o" in the "evaluation results" column indicates that the substrate was easily removed from the substrate holding base 13, and "x" in the same column indicates that the substrate was not easily removed from the substrate holding base 13.

In the experiments, the substrate of a pyrex glass is used, and the back surface of the substrate is ground to a surface roughness level 0.05 s (mirror finish). The line shaped grooves with difference depths are formed by using a diamond cutter with respective substrate samples. The substrate holding base is of The substrate holding base 13 is of a stainless steel SUS340, and the surface of the substrate holding base 13 is finished to the surface roughness level 0.05 s (mirror finish) by using a grinding wheel. The substrate samples used are three types: 2 mm thickness, 4 mm thickness and 10 mm thickness. The sizes of the substrate samples are 420 mm×300 mm, 1200 mm×800 mm, and 3500 mm×1800 mm. As shown in FIG. 6, the lattice formation of the line shaped grooves L of each substrate sample includes three equally spaced grooves in the two orthogonal directions.

From the above test results, it is found out that the problem of the substrate handling (or the substrate sticking) can be overcome by setting the ratio of the substrate thickness "t" to the line shaped groove depth "d" to be in a range from 5 to 50. If the ratio is above the upper limit 50, the problem of the substrate sticking occurs. If the ratio is below the lower limit 5, the damaging of the substrate occurs.

Figure 8A:
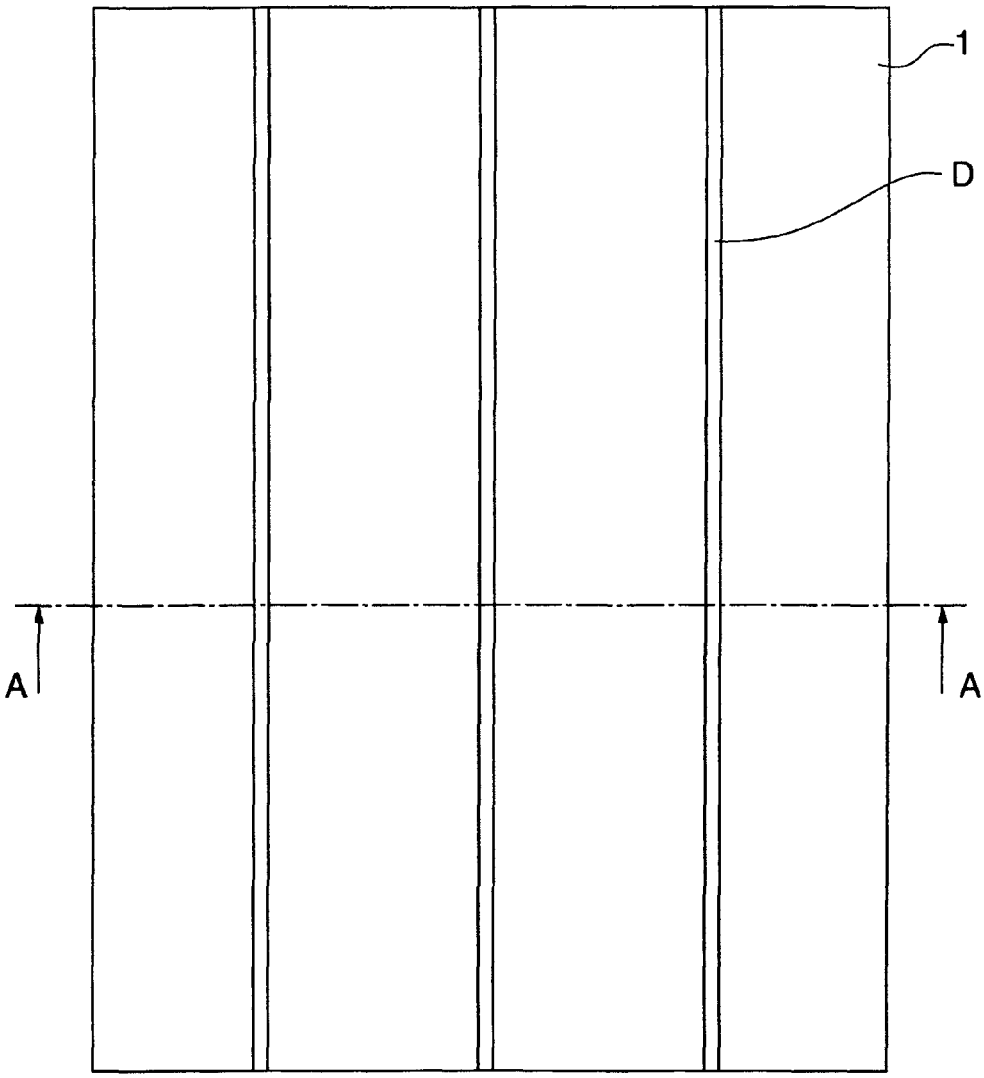
FIG. 8A and FIG. 8B are diagrams showing another embodiment of the substrate that is appropriate for the electron-emitting device of the invention.
Figure 8B:
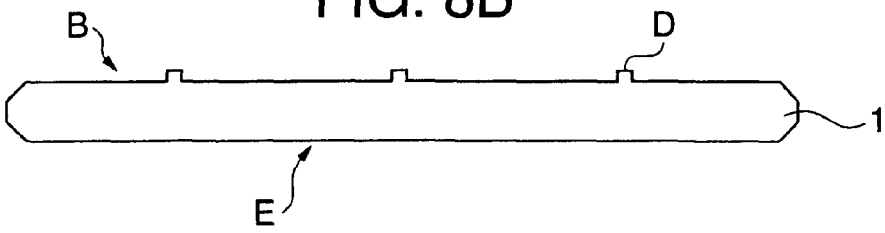

FIG. 8A and FIG. 8B show another embodiment of the substrate that is appropriate for the electron-emitting device of the invention. FIG. 8A is a plan view of the back surface of the substrate 1, and FIG. 8B is a cross-sectional view of the substrate 1 taken along a line A-A in FIG. 8A. In these figures, "B" indicates the back surface of the substrate 1, "E" indicates the front surface of the substrate 1, and "D" indicates a line shaped projection on the back surface.

As shown in FIG. 8A and FIG. 8B, in the present embodiment, the substrate 1 is provided with three line shaped projections "D" that are arranged in parallel in a straight-line formation. The vacuum condition between the substrate and the substrate holding base is avoided by the use of the line shaped projections D in the present embodiment, and the substrate 1 of the present embodiment is effective in overcoming the problem of the substrate sticking.

When manufacturing the electron-emitting device, if the substrate of silica glass or $SIO_2$ alumina is in a generally rectangular shape having the sides with sharp corners, such substrate is liable to injuring the operator of the production apparatus during manufacture of the electron-emitting device. Hence, it is desirable to take safety measures for protecting the operator against injury concerning the substrate of the electron-emitting device.

Figure 9A:
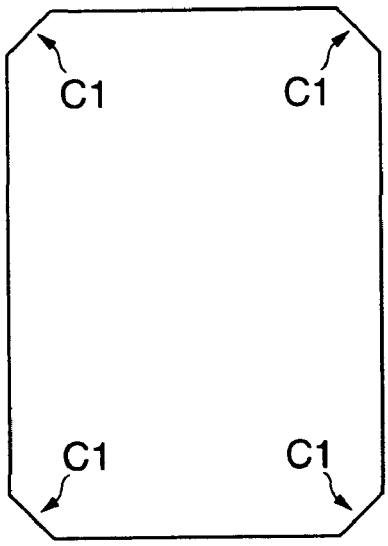
FIG. 9A and FIG. 9B are diagrams showing another embodiment of the substrate that is appropriate for the electron-emitting device of the invention.
Figure 9B:
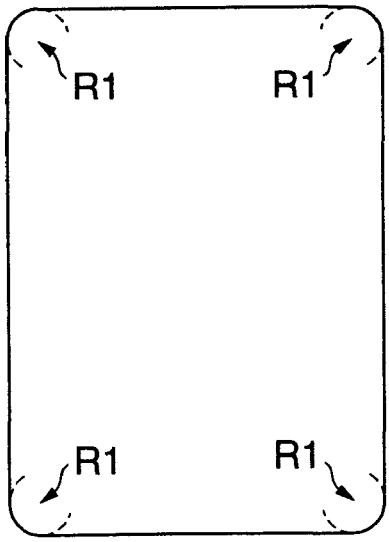

FIG. 9A and FIG. 9B show another embodiment of the substrate that is appropriate for the electron-emitting device of the invention.

As shown in FIG. 9A, the substrate of this embodiment is in a rectangular shape with four corners, and the four corners are straightly chamfered as indicated by a machining drawing symbol "C1". As shown in FIG. 9B, the substrate of this embodiment is in a rectangular shape with four corners, and the four corners are roundly chamfered as indicated by a machining drawing symbol "R1". The electron-emitting device of the present embodiment is effective in protecting the protecting the operator against injury during manufacture.

Figure 10:
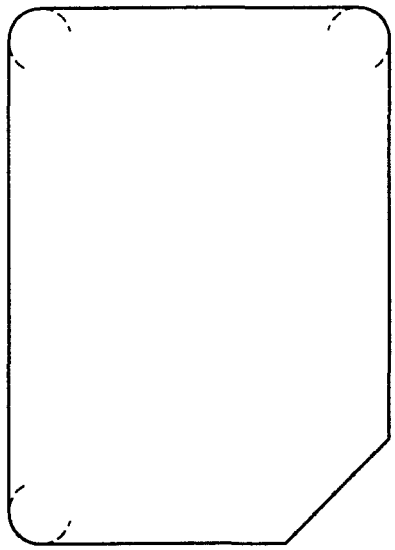
FIG. 10 is a diagram showing another embodiment of the substrate that is appropriate for the electron-emitting device of the invention.

FIG. 10 shows another embodiment of the substrate that is appropriate for the electron-emitting device of the invention.

As shown in FIG. 10, the substrate of this embodiment is in a rectangular shape with four corners, and three of the four corners are roundly chamfered, and the remaining corner is straightly chambered. Namely, in the present embodiment, at least one of the four corners of the substrate of the electron-emitting device is formed in a configuration that is distinguishable from a configuration of the other corners. The electron-emitting device of the present embodiment is effective in providing easy detection of the orientation of the substrate for the operator while protecting the operator against injury during manufacture.

Figure 11:
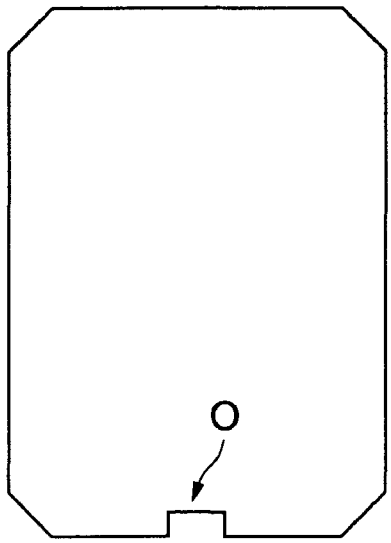
FIG. 11 is a diagram showing another embodiment of the substrate that is appropriate for the electron-emitting device of the invention.

FIG. 11 shows another embodiment of the substrate that is appropriate for the electron-emitting device of the invention.

As shown in FIG. 11, the substrate of this embodiment is in a rectangular shape with four sides and four corners, and the four corners are straightly chamfered, and one of the four sides is formed to include a cut-out portion "O". Namely, in the present embodiment, at least one of the four sides of the substrate of the electron-emitting device is formed to include a cut-out portion that is distinguishable from a configuration of the other sides. The electron-emitting device of the present embodiment is effective in providing easy detection of the orientation of the substrate for the operator while protecting the operator against injury during manufacture.

Figure 12A:
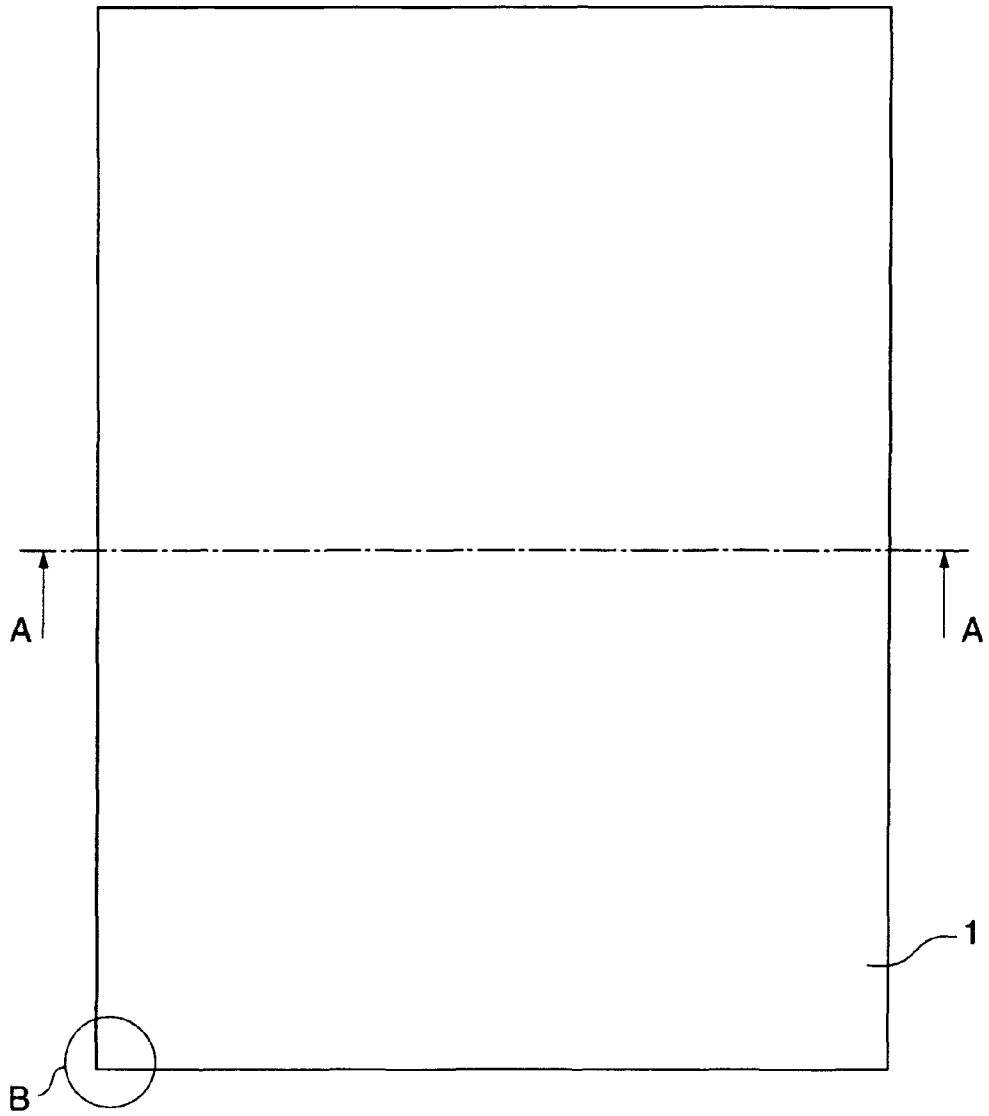
FIG. 12A and FIG. 12B are diagrams showing another embodiment of the substrate that is appropriate for the electron-emitting device of the invention.
Figure 12B:
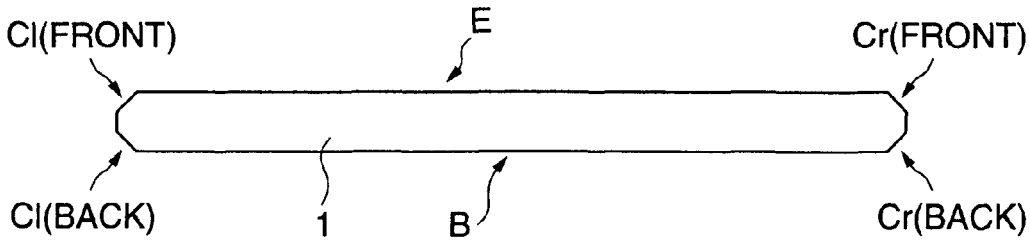

FIG. 12A and FIG. 12B show another embodiment of the substrate that is appropriate for the electron-emitting device of the invention.

As shown in FIG. 12A and FIG. 12B, in the present embodiment, edges of the substrate 1 between the front surface and the side surfaces perpendicular to the front surface are chamfered as indicated by "Cl (front)" and "Cr (front)", for the purpose of protecting the operator against injury during manufacture.

Slanted surfaces are formed along these edges as a result of the chamfering of the edges between the front surface and the sides surfaces. Two adjacent ones of the slanted surfaces intersect each other at one of the four corners of the substrate 1. Further, in the present embodiment, edges of the substrate 1 between the back surface and the side surfaces perpendicular to the back surface are chamfered as indicated by "Cl (back)" and "Cr (back)", for the same purpose.

Therefore, the electron-emitting device that uses the substrate of the present embodiment is effective in protecting the protecting the operator against injury during manufacture.

Figure 13:
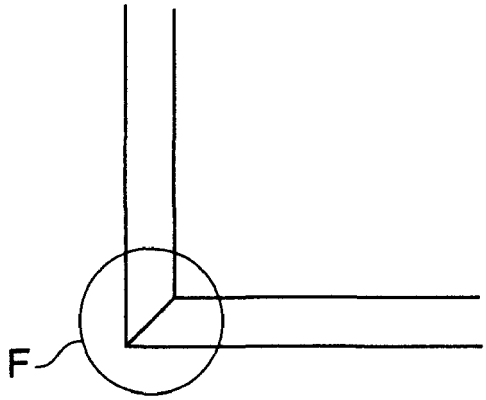
FIG. 13 is a diagram for explaining a chamfered portion at a corner of another embodiment of the substrate that is appropriate for the electron-emitting device of the invention.

FIG. 13 is a diagram for explaining a chamfered portion at a corner of another embodiment of the substrate appropriate for the electron-emitting device of the invention.

As shown in FIG. 13, in the present embodiment, the two adjacent ones of the slanted surfaces as a result of the chamfering of the edges are further chamfered at one of the four corners of the substrate 1 as indicated by "F", for the purpose of protecting the operator against injury. Therefore, The electron-emitting device of the present embodiment is effective in protecting the protecting the operator against injury during manufacture.

Figure 14A:
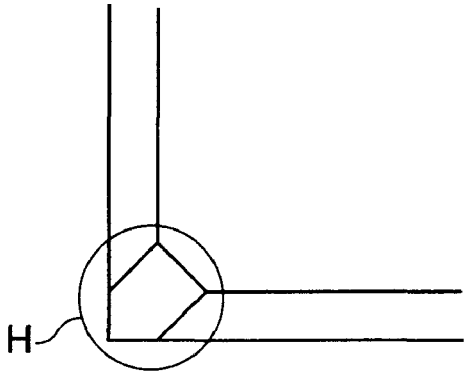
FIG. 14A and FIG. 14B are diagrams for explaining a chamfered portion at a corner of another embodiment of the substrate that is appropriate for the electron-emitting device of the invention.
Figure 14B:
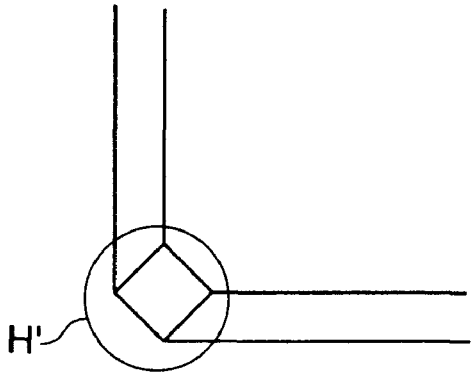

FIG. 14A and FIG. 14B are diagrams for explaining a chamfered portion at a corner of another embodiment of the substrate that is appropriate for the electron-emitting device of the invention.

As shown in FIG. 14A and FIG. 14B, in the present embodiment, the two adjacent ones of the slanted surfaces as a result of the chamfering of the edges are further chamfered at one of the four corners of the substrate 1 as indicated by "H" and "H'", for the purpose of protecting the operator against injury. Therefore, The electron-emitting device of the present embodiment is effective in protecting the protecting the operator against injury during manufacture.

One important aspect of the present invention is to provide an electron-emitting device that is applicable to an image display apparatus providing a displayed image with high quality. The size of a display panel of the image display apparatus ranges from a middle size of 300 mm×450 mm to a large size of 2000 mm×3000 mm. In order to attain this goal, it is important to provide an electron-emitting device production apparatus that enables easy production of the electron-emitting device in which the electron-emitting elements are formed with high accuracy and low cost. To provide such production apparatus, it is important to determine an appropriate positional relationship between the discharge head and the substrate held on the substrate holding base in the production apparatus.

Experiments have been performed to examine the status of electron-emitting elements formed on the substrate when the distance between the discharge head and the substrate on the substrate holding base in the production apparatus is varied.

Figure 15:
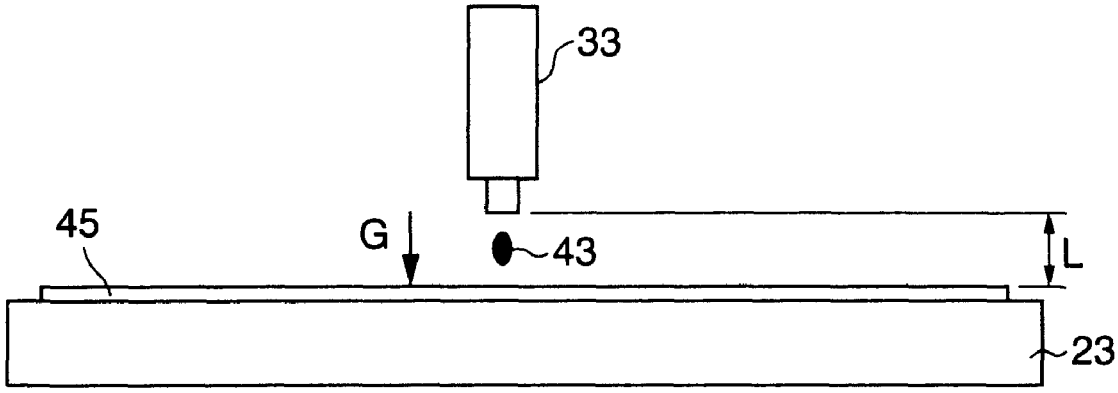
FIG. 15 is a diagram for explaining a positional relationship between the discharge head and the substrate held on the substrate holding base in the electron-emitting device production apparatus of the invention.
Figure 16:
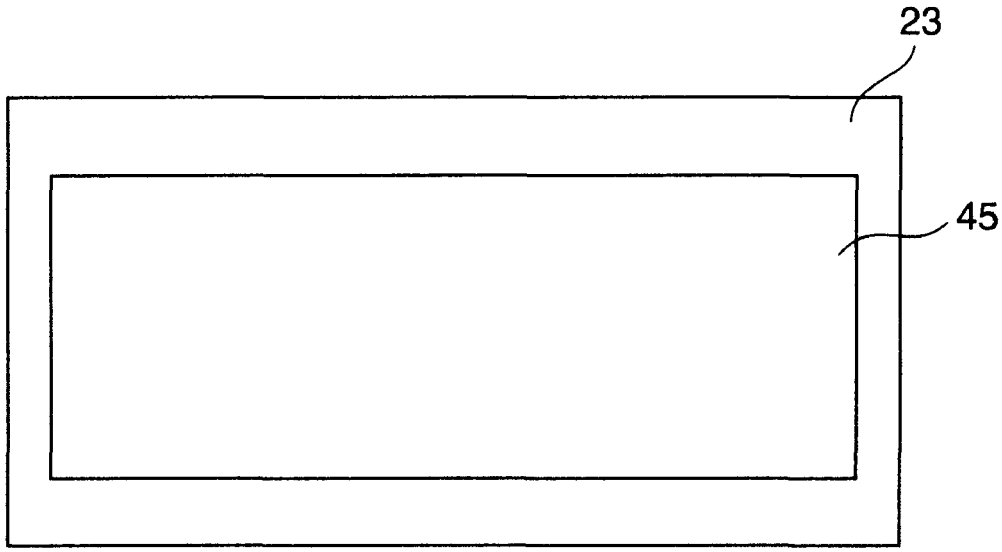
FIG. 16 is a diagram for explaining a positional relationship between the substrate and the substrate holding base shown in FIG. 15.

Regarding the above-described experiments, FIG. 15 shows a positional relationship between the discharge head 33 and the substrate 45 held on the substrate holding base 23 in the electron-emitting device production apparatus of the invention. FIG. 16 shows a positional relationship between the substrate 45 and the substrate holding base 23 shown in FIG. 15.

As shown in FIG. 15 and FIG. 16, the substrate holding base 23 holds the substrate 45 at a controlled horizontal position under the discharge surface of the discharge head 33. Suppose that a vertical distance from the front surface of the substrate 45 to the discharge surface of the discharge head 33 is indicated by "L", and the drop 43 from the discharge head 33 is discharged to the substrate 45 in the vertical direction (or in the direction of gravity) indicated by the arrow "G".

In the above experiments, the status of electron-emitting elements formed on the substrate 45 is examined when the distance "L" between the discharge head 33 and the substrate 45 on the substrate holding base 23 in the production apparatus is varied. The following TABLE 4 provides the results of the experiments.

TABLE 4

| Length L [mm] | E/E Element Form Status |
|---|---|
| 0.05 | x |
| 0.1 | o |
| 1 | o |
| 2 | o |
| 3 | o |
| 4 | o |
| 5 | o |
| 6 | o |
| 7 | o |
| 8 | o |
| 9 | o |
| 10 | o |
| 11 | Δ |
| 12 | Δ |
| 13 | x |

In the experiments, the source material of the conductive thin film used is an aqueous solution of 2.0 wt % of palladium acetate-triethanolamine (PA-TE). The discharge head 33 used in the experiments is an edge-shooter thermal ink jet head. The nozzle diameter is 26 μm. The size of the heater is 26 μm×118 μm. The resistance of the heater is 101Ω. The drive voltage of the discharge head is 24.5 V. The pulse width of the signal is 6 μs. The initial discharge speed of the discharge head 33 is about 6 m/s. The transport speed of the head carriage to transport the discharge head 33 is 5 m/s.

In the above TABLE 4, "o" in the "e/e element form status" column indicates that a suitable electron-emitting element was formed on the substrate, and "x" in the same column indicates that an unsuitable electron-emitting element was formed on the substrate.

From the above test results, it is found out that the formation of accurate electron-emitting elements on the substrate is allowed by setting the distance L between the front surface of the substrate 45 and the discharge surface of the discharge head 33 in a range from 0.1 mm to 10 mm.

Further, in order to provide an electron-emitting device production apparatus that enables easy production of the electron-emitting device in which the electron-emitting elements are formed with high accuracy and low cost, it is important to determine an appropriate relationship between the discharge speed of the discharge head and the transport speed of the head carriage in the production apparatus.

Experiments have been performed to examine the status of electron-emitting elements formed on the substrate when the relationship between the discharge speed and the transport speed in the production apparatus is varied. In the above experiments, the status of electron-emitting elements formed on the substrate 14 is examined when the relationship between the discharge speed of the discharge head 11 and the transport speed (in the X direction) of the head carriage 12 in the production apparatus of FIG. 3 is varied. The following TABLE 5 provides the results of the experiments.

TABLE 5

| Test No. | Discharge Speed Vj [m/s] | X-direction Scan Speed Vc [m/s] | E/E Element Form Status |
|---|---|---|---|
| 1 | 3 | 1 | o |
| 2 | 3 | 2 | o |
| 3 | 3 | 3 | x |
| 4 | 3 | 4 | x |
| 5 | 5 | 2 | o |
| 6 | 5 | 3 | o |
| 7 | 5 | 4 | o |
| 8 | 5 | 5 | x |
| 9 | 5 | 6 | x |
| 10 | 7 | 4 | o |
| 11 | 7 | 5 | o |
| 12 | 7 | 6 | o |
| 13 | 7 | 7 | x |
| 14 | 7 | 8 | x |
| 15 | 10 | 7 | o |
| 16 | 10 | 8 | o |
| 17 | 10 | 9 | o |
| 18 | 10 | 10 | x |
| 19 | 10 | 11 | x |

In the experiments, the production apparatus shown in FIG. 3 is used. The source material of the conductive thin film used is an aqueous solution of 2.0 wt % of palladium acetate-triethanolamine (PA-TE). The discharge head 14 used in the experiments is an edge-shooter thermal ink jet head. The nozzle diameter is 26 μm. The size of the heater is 26 μm×118 μm. The resistance of the heater is 101Ω. The drive voltage of the discharge head ranges from 24 V to 27 V. The pulse width of the signal is 6 μs. The energy needed to discharge a drop ranges from 34 μJ to 43 μJ.

In the above TABLE 5, "o" in the "e/e element form status" column indicates that a suitable electron-emitting element was formed on the substrate, and "x" in the same column indicates that an unsuitable electron-emitting element was formed on the substrate.

From the above test results, it is found out that the formation of accurate electron-emitting elements on the substrate is allowed by setting the discharge speed of the discharge head to be larger than the transport speed of the head carriage Further, in order to provide an electron-emitting device production apparatus that enables easy production of the electron-emitting device in which the electron-emitting elements are formed with high accuracy and low cost, it is important to determine an appropriate range of the discharge speed of the discharge head in the production apparatus.

Experiments have been performed to examine the status of the dot formed on the substrate (the dot shape and the occurrence of fine drop scattering) when the discharge speed of the discharge head in the production apparatus is varied from 0.5 m/s to 12 m/s. The following TABLE 6 provides the results of the experiments.

TABLE 6

| Test No. | Discharge Speed [m/s] | Dot Position Accuracy | Dot Shape | Fine Drop Scattering |
|---|---|---|---|---|
| 1 | 0.5 | x | Δ | o |
| 2 | 1 | x | Δ | o |
| 3 | 2 | x | Δ | o |
| 4 | 3 | x | Δ | o |
| 5 | 4 | x | Δ | o |
| 6 | 5 | x | Δ | o |
| 7 | 6 | x | Δ | o |
| 8 | 7 | x | Δ | o |
| 9 | 8 | x | Δ | o |
| 10 | 9 | x | Δ | o |

TABLE 6-continued

| Test No. | Discharge Speed [m/s] | Dot Position Accuracy | Dot Shape | Fine Drop Scattering |
|---|---|---|---|---|
| 11 | 10 | x | Δ | o |
| 12 | 11 | x | Δ | o |
| 13 | 12 | x | Δ | o |

In the experiments, the source material of the conductive thin film used is an aqueous solution of 2.0 wt % of palladium acetate-triethanolamine (PA-TE). The discharge head used in the experiments is an edge-shooter thermal ink jet head. The nozzle diameter is 25 μm. The size of the heater is 25 μm×90 μm. The resistance of the heater is 118Ω. The drive voltage of the discharge head ranges from 20 V to 24 V. The pulse width of the signal ranges from 5 μs to 7 μs. The transport speed of the head carriage is 0.3 m/s.

In the above TABLE 6, "o" in the "dot position accuracy" column indicates that the position of the dot on the substrate was within the range of ½ of the dot diameter, and "x" in the same column indicates that the position of the dot on the substrate fell outside the range of ½ of the dot diameter. "o" in the "dot shape" column indicates that a suitably round dot was formed on the substrate, "Δ" in the same column indicates that a non-round dot was formed on the substrate, and "x" in the same column indicates that an unsuitable dot was formed on the substrate. "o" in the "fine dot scattering" column indicates that a fine dot scattering did not occur, and " " in the same column indicates that a fine dot scattering occurred.

From the above test results, it is found out that the formation of accurate electron-emitting elements on the substrate is allowed by setting the discharge speed of the discharge head in a range from 3 m/s to 10 m/s.

In a case in which the formation of the electron-emitting elements on the substrate does not require high accuracy, the discharging of a single, large drop to the substrate is sufficient to form one of the electron-emitting elements on the substrate.

Figure 17:
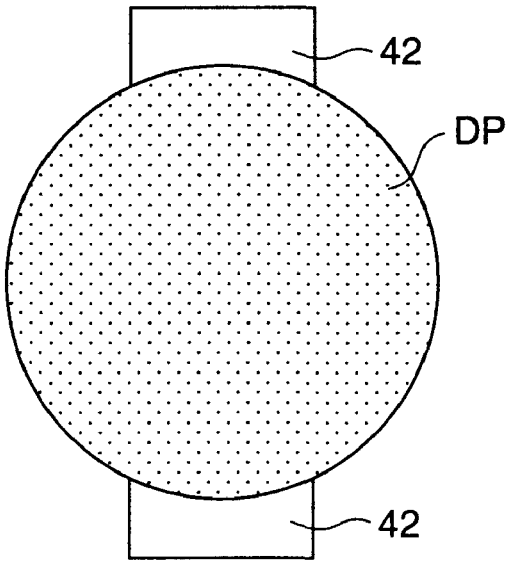
FIG. 17 is a diagram for explaining a formation of a dot pattern on the substrate through discharging of a single drop.

FIG. 17 is a diagram for explaining a formation of a dot pattern "DP" on the substrate through discharging of a single drop thereto. In the example of FIG. 17, the distance between the opposing electrodes 42 on the substrate ranges from 5 mm to 10 mm, and the diameter of the dot in the dot pattern "DP" that is produced through the discharging of the single drop to the substrate ranges from 8 mm to 15 mm. If the formation of the electron-emitting elements on the substrate does not require high accuracy, the formation of the dot pattern "DP" on the substrate, as shown in FIG. 17, is adequate.

However, according to the objective of the electron-emitting device of the present invention, it is necessary to achieve the formation of high-accuracy electron-emitting elements on the substrate with low cost.

Figure 18:
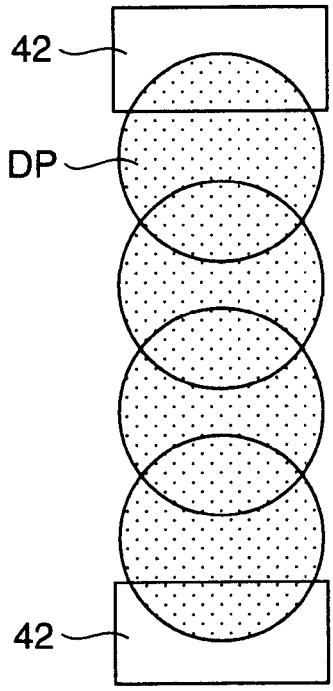
FIG. 18 is a diagram for explaining a formation of a dot pattern on the substrate through discharging of a plurality of drops.

FIG. 18 is a diagram for explaining a formation of a dot pattern "DP" on the substrate through discharging of a plurality of drops thereto.

In the example of FIG. 18, the distance between the opposing electrodes 42 on the substrate is approximately 140 μm. This is equivalent to the case of the formation of a 600 dpi (dots per inch) pattern of the dots on the substrate of the electron-emitting device. In order to achieve the formation of high-accuracy electron-emitting elements, the diameter of one dot in the dot pattern "DP" that is produced through the discharging of the four drops to the substrate must be as small as 65 μm. The source material of the conductive thin film used in the example of FIG. 18 is an aqueous solution of 4.0 wt % of palladium acetate-triethanolamine (PA-TE). The discharge head used in this example is an edge-shooter thermal ink jet head. The nozzle diameter is 28 μm. The size of the heater is 28 μm×90 μm. The resistance of the heater is 121Ω. The drive voltage of the discharge head is 24.6 V. The pulse width of the drive signal is 16 μs. The energy needed to discharge a drop is about 30 μJ. The discharge speed of the head is about 7 m/s.

Figure 19:
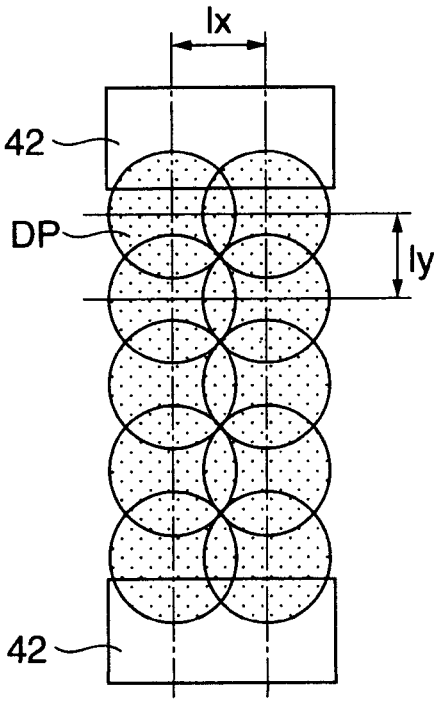
FIG. 19 is a diagram for explaining a formation of another dot pattern on the substrate through discharging of a plurality of drops.

FIG. 19 is a diagram for explaining a formation of another dot pattern "DP" on the substrate through discharging of a plurality of drops thereto.

In the example of FIG. 19, the distance between the opposing electrodes 42 on the substrate is approximately 140 μm. Similar to the example of FIG. 18, this is equivalent to the case of the formation of the 600 dpi pattern of the dots on the substrate of the electron-emitting device. Unlike the example of FIG. 18, the dot pattern "DP" in the present example is formed to include two rows of five dots between the opposing electrodes 42, and these dots of the pattern "DP" are overlapped in two orthogonal directions. In order to achieve the formation of high-accuracy electron-emitting elements, the diameter of one dot in the dot pattern "DP" that is produced through the discharging of the 2×5 drops to the substrate must be as small as 45 μm.

The source material of the conductive thin film used in the example of FIG. 19 is an aqueous solution of 2.0 wt % of palladium acetate-triethanolamine (PA-TE). The discharge head used in this example is an edge-shooter thermal ink jet head. The nozzle diameter is 20 μm. The size of the heater is 20 μm×60 μm. The resistance of the heater is 102Ω. The drive voltage of the discharge head is 13.5 V. The pulse width of the drive signal is 4 μs. The frequency of the drive signal is 16 kHz. The energy needed to discharge a drop is about 7.1 μJ. The discharge speed of the head is about 6 m/s.

Further, in the example of FIG. 19, the dot pattern "DP" is formed to include two rows of five dots between the opposing electrodes 42, and the dots of the pattern "DP" are overlapped in the two orthogonal directions. In order to achieve the formation of a high-accuracy electron-emitting element on the substrate with no uncovered portion, it is necessary that the background portion of the substrate between the electrodes 42 be fully covered with the dot pattern "DP" of this example. For this purpose, the dot pattern "DP" in this example is configured such that each of center distances "lx" and "ly" between the two adjacent ones of the dots in the two orthogonal directions, as shown in FIG. 19, is less than $1/\sqrt{2}$ times the diameter of one of the dots.

Therefore, when the multiple-row dot pattern "DP" as in the example of FIG. 19 is formed by using the discharge head of the production apparatus, it is required that the discharging of the drops to the substrate must satisfy the above-mentioned conditions, in order to achieve the formation of high-accuracy electron-emitting elements on the substrate with no uncovered portion.

Figure 20A:
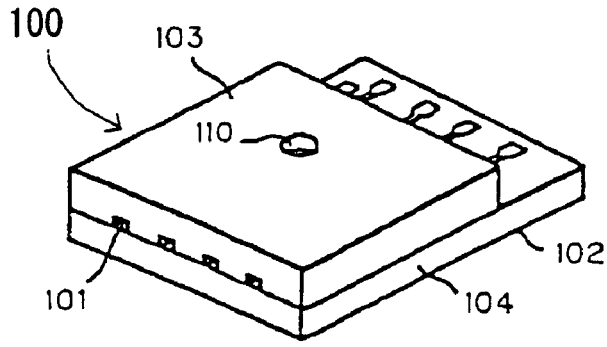
FIG. 20A, FIG. 20B and FIG. 20C are diagrams showing a discharge head in the electron-emitting device production apparatus of the invention.
Figure 20B:
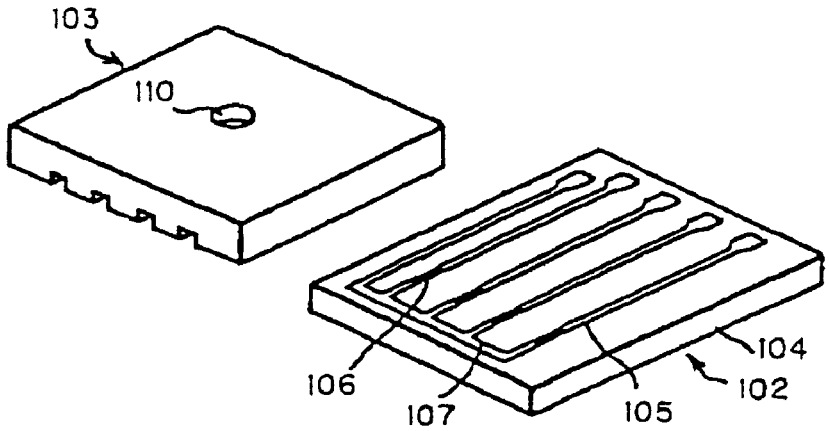
Figure 20C:
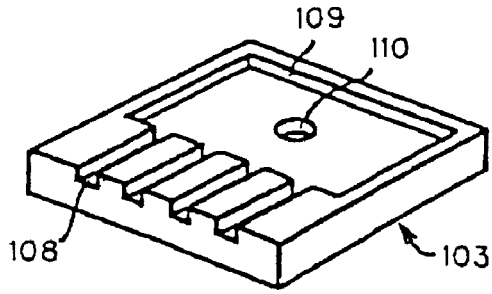

Next, FIG. 20A, FIG. 20B and FIG. 20C show a discharge head 100 in the electron-emitting device production apparatus of the invention. The discharge head 100 is configured to include multiple nozzles 101 on its discharge surface. In this embodiment, the number of the multiple nozzles in the discharge head 100 is four. FIG. 20A is an assembled view of the discharge head 100, FIG. 20B is an exploded view of the discharge head 100, and FIG. 20C is a bottom view of a lid plate of the discharge head 100.

As shown in FIG. 20A and FIG. 20B, a heater plate 102 and a lid plate 103 are bonded together to form the discharge head 100 of the present embodiment. In the heater plate 102, a set of individual electrodes 105, a common electrode 106, and a set of heating elements 107 are formed on a silicon substrate 104 through a wafer fabrication process. The heating elements 107 are the source that generates energy needed to discharge drops from the nozzles of the discharge head 100.

As shown in FIG. 20B and FIG. 20C, in the lid plate 103, a set of grooves 108 are formed as part of liquid passages that introduce the liquid of the source material of the conductive thin film 4 to the respective nozzles 101. A recessed region 109 is formed on the back surface of the lid plate 103 to provide a common chamber that contains the liquid of the source material to be supplied to the nozzles. The liquid passages and the common chamber are formed by bonding the heater plate 102 and the lid plate together. Further, in the lid plate 103, a liquid inlet 110 is formed in the middle of the lid plate 103. The liquid of the source material from a liquid source (not shown) is supplied through the inlet 110 into the common chamber of the discharge head 100.

More specifically, in the discharge head 100 of this embodiment, the four nozzles 101 are provided, a unit pitch between two of the nozzles 101 is set at about 42.3 μm, and a total pitch between the outermost ones of the nozzles 101 is set at about 127 μm. The total pitch of this discharge head is nearly equal to the distance (140 μm) between the opposing electrodes in a case of the formation of a 600 dpi (dots per inch) pattern of the dots on the substrate of the electron-emitting device.

The discharge head 100 in the production apparatus of the above-mentioned embodiment includes the multiple nozzles 101, which provides efficient means for discharging the drops of the source material of the film 4 to the substrate 1.

The discharge head according to the present invention is not limited to the discharge head 100 having the four nozzles in the above embodiment. For example, in a case of a discharge head having six nozzles, the unit pitch between two of the nozzles 101 is set at about 42.3 μm, and the total pitch between the outermost ones of the nozzles 101 is set at about 212 μm. The total pitch of this discharge head is larger than the distance (140 μm) between the opposing electrodes in a case of the formation of a 600 dpi (dots per inch) pattern of the dots on the substrate of the electron-emitting device.

Figures 21A, 21B, 21C:
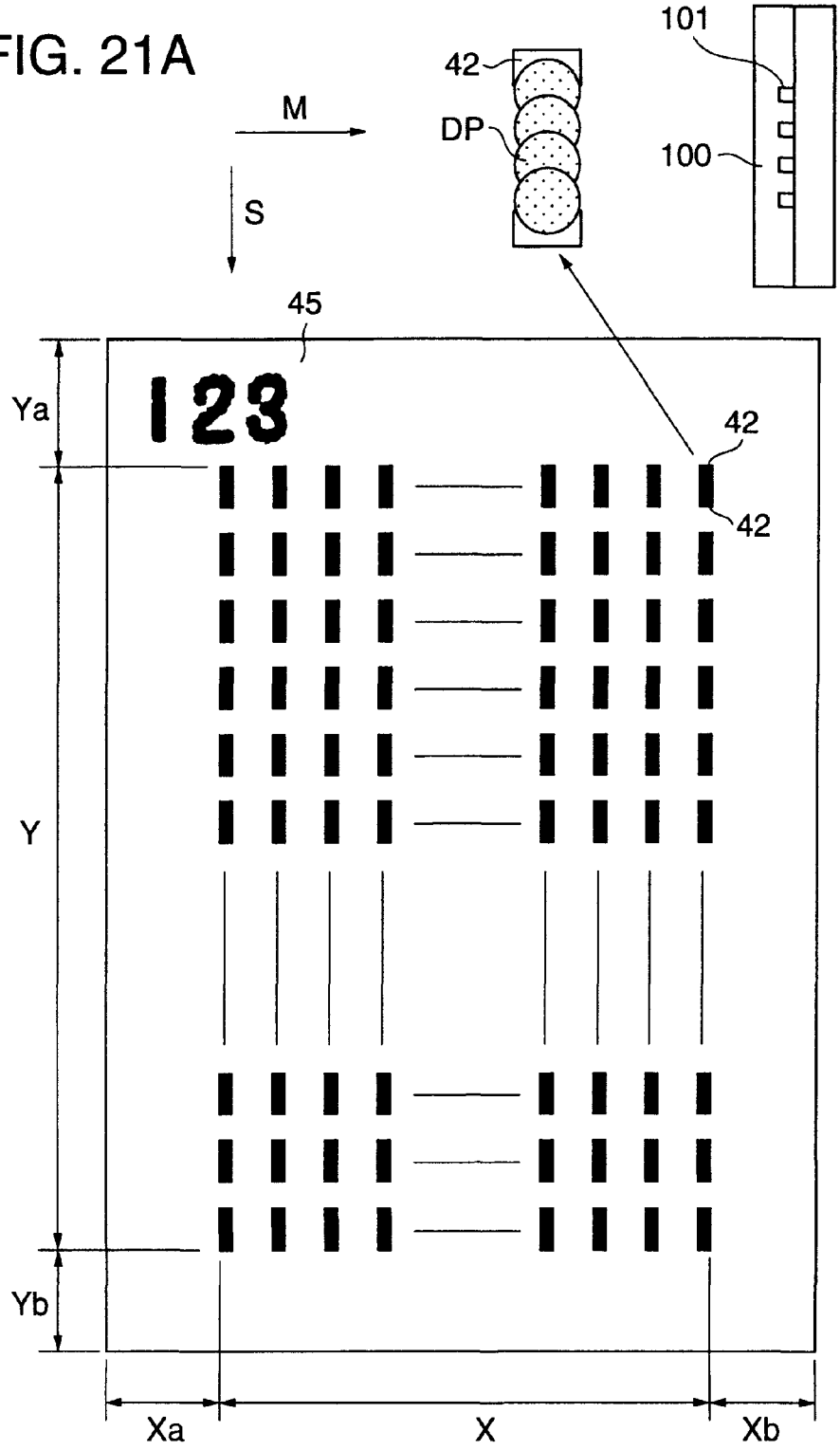
FIG. 21A, FIG. 21B and FIG. 21C are diagrams for explaining another embodiment of the substrate that is appropriate for the electron-emitting device of the invention.

FIG. 21A, FIG. 21B and FIG. 21C show another embodiment of the substrate that is appropriate for the electron-emitting device of the invention. FIG. 21A is a plan view of the substrate 45 on which the matrix formation electron-emitting elements are formed. FIG. 21B is an enlarged view of a dot pattern DP for one of the electron-emitting elements, which is disposed between the opposing electrodes 42 of one of the plurality of the electrode pairs on the substrate 45. FIG. 21C is a front view of the discharge head 100 that is appropriate to form the dot pattern DP on the substrate 45.

As shown in FIG. 21C, the discharge head 100 of the production apparatus in the present embodiment includes the four nozzles 101 on the discharge surface. Suppose that the production apparatus of this embodiment is the same as that shown in FIG. 3, for the sake of simplicity of description. The production apparatus of this embodiment is arranged such that the array of the nozzles 101 of the discharge head 100 is parallel to the sub-scanning direction (which is indicated by the arrow "S" in FIG. 21A) of the relative movement of the head 100 and the substrate 45.

As shown in FIG. 21B, by discharging the four drops from the discharge head 100 of FIG. 21C to the substrate 45, the dot pattern DP is disposed between the opposing electrodes 42 of one of the electrode pairs of the substrate 45. In the present embodiment, for every discharge of the four drops, the discharge head 100 forms the dot pattern DP at the location between the opposing electrodes 42 of one of the electrode pairs on the substrate 45. Each of the electron-emitting elements is produced on the substrate 45 through the dot pattern DP which is formed by the discharge head 100.

As shown in FIG. 21A, on the substrate 45 of the present embodiment, the electron-emitting elements are arrayed in a matrix formation, and the matrix of the electron-emitting elements has rows and columns in the two orthogonal directions. The electron-emitting elements are disposed such that the orthogonal directions of the rows and columns of the matrix are parallel to the orthogonal directions of the sides of the substrate 45.

Further, in the present embodiment, the production apparatus is configured such that the effective area in which the discharge head 100 is capable of discharging the drops to the substrate 45 is larger than the entire region (X, Y) that covers the electron-emitting elements on the substrate 45. Namely, the substrate 45 includes, as shown in FIG. 21A, peripheral regions "Xa" and "Xb" in the main scanning direction "M", located outside the region "X", and peripheral regions "Ya" and "Yb" in the sub-scanning direction "S", located outside the region "Y", and the discharge head 100 is capable of discharging the drops to at least the peripheral region "Ya" of the substrate 45 outside the region "Y".

As a result of the discharging of the drops from the discharge head 100, the substrate 45 in this embodiment includes a device identification pattern (indicated as "123" in FIG. 21A) in the peripheral region "Ya", which is disposed outside the region "Y" of the electron-emitting elements on the substrate 45. The device identification pattern in this embodiment is, for example, a production lot no., a production date, or another indication that is assigned for a specific one of the individual electron-emitting devices after the manufacture. The electron-emitting device of the present embodiment is effective in providing easy identification of the electron-emitting device for the operator of the production apparatus during the manufacture.

Figure 22B:
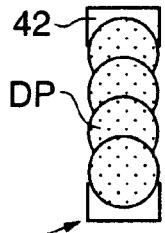
FIG. 22A and FIG. 22B are diagrams for explaining another embodiment of the substrate that is appropriate for the electron-emitting device of the invention.
Figure 22A:
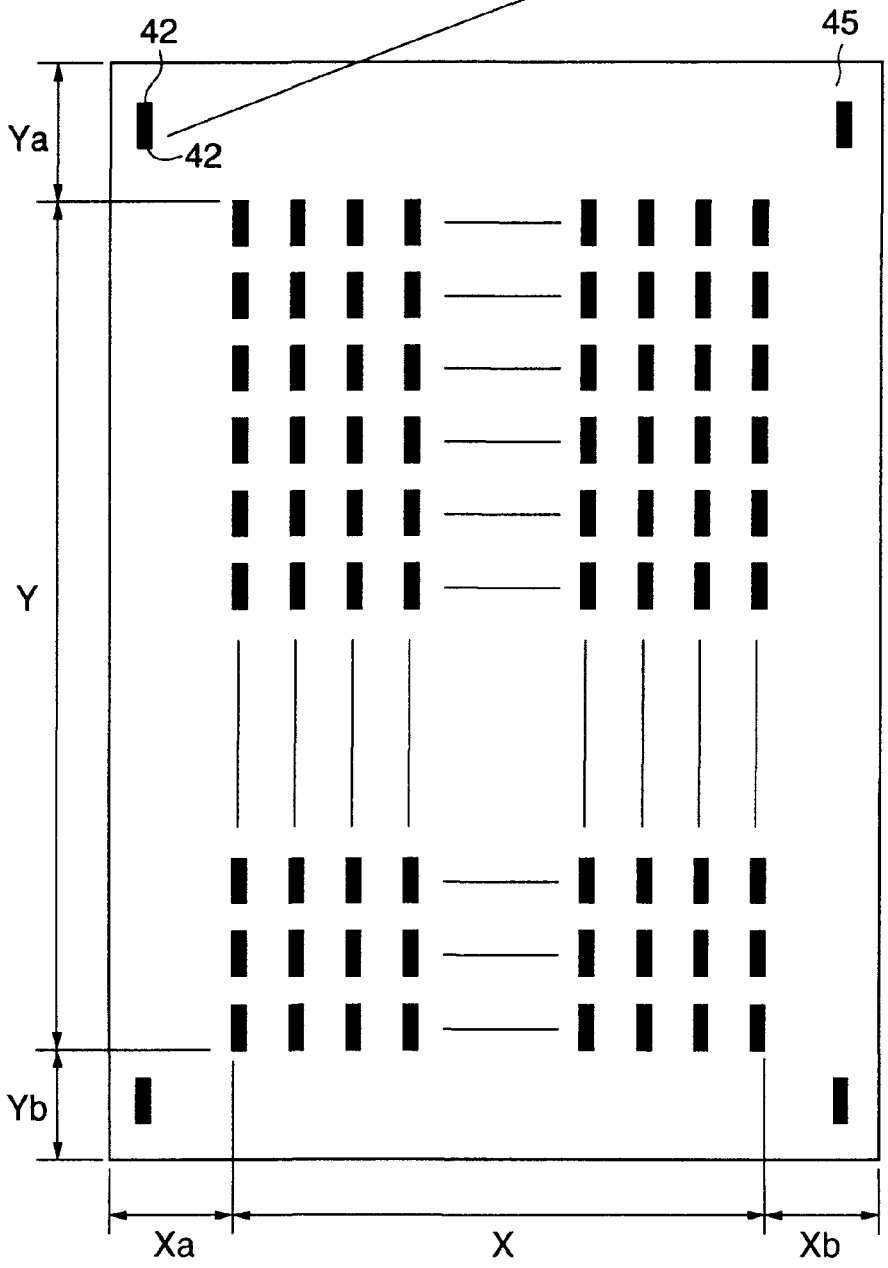

FIG. 22A and FIG. 22B show another embodiment of the substrate that is appropriate for the electron-emitting device of the invention. FIG. 21A is a plan view of the substrate 45 on which the matrix formation electron-emitting elements are formed. FIG. 21B is an enlarged view of a dot pattern DP for one of second electron-emitting elements, which is disposed between the opposing electrodes 42 of one of the plurality of the electrode pairs on the substrate 45.

In FIG. 22A and FIG. 22B, the elements which are essentially the same as corresponding elements in FIG. 21A and FIG. 21B are designated by the same reference numerals, and a description thereof will be omitted.

Unlike the previous embodiment of FIG. 21A, the substrate 45 in this embodiment includes a pair of opposing electrodes 42 at each of the four corners, in addition of the plurality of the electrode pairs for the matrix formation electron-emitting elements on the substrate 45.

Similar to the previous embodiment of FIG. 21A, as a result of the discharging of the drops from the discharge head 100, the substrate 45 in this embodiment includes a bar-shaped pattern at each corner of the substrate 45 in the peripheral regions "XaYa", "XaYb", "XbYa" and "XbYb", which are disposed outside the regions "XY" that covers the matrix formation electron-emitting elements on the substrate 45. The bar-shaped patterns of this embodiment are formed between the opposing electrodes 42 at the four corners, respectively, in the same manner as the matrix formation electron-emitting elements, namely through the discharging of the drops to the substrate 45. Hence, the bar-shaped patterns of the substrate 45 of this embodiment are parallel to the two orthogonal directions of the sides of the substrate 45.

The bar-shaped patterns of the substrate 45 of this embodiment serve as a performance check pattern that is disposed outside the entire region "XY" of the matrix formation electron-emitting elements of the substrate 45. As described above, the bar-shaped patterns are produced by the same production apparatus and in the same manner as the matrix formation electron-emitting elements on the substrate 45. Therefore, the electron-emitting device of the present embodiment is effective in facilitating easy testing of performance of the electron-emitting device after the manufacture.

An ideal measure that is taken for the testing of performance of the electron-emitting device after the manufacture is that performance checking of the electron-emitting device after the manufacture is carried out with respect to all of the matrix formation electron-emitting elements in the electron-emitting device. However, taking such measure is considerably time-consuming, which will extremely increase the manufacturing cost. The performance checking of only the bar-shaped patterns of this embodiment does not cause the increase of the manufacturing cost and can be completed for a relatively short time.

In the above-described embodiment, the bar-shaped pattern is disposed at each of the four corners of the substrate 45. However, the electron-emitting device of the present invention is not limited to this embodiment. For example, only one bar-shaped pattern may be provided at one of the four corners of the substrate 45, for the purpose of performance checking.

Next, a description will be given of a method of forming the electron-emitting region 5 in the conductive thin film 4 on the substrate 1.

As described above with reference to FIG. 2C, the electron-emitting region 5 is formed by performing the so-called "forming", before effecting the electron emission. Specifically, a forming voltage is applied between the electrode 2 and the electrode 3 to energize the film 4 such that the film 4 is locally destroyed or deformed owing to the Joule heat. The applied voltage causes the electron-emitting region 5 to be held in a state of electrically high resistance, so that the electron-emitting region 5 carries an electron-emitting function.

The state of electrically high resistance of the electron-emitting region 5 is given by a discontinuous state of the film 4 partly having cracks on the surface of the film 4. In the surface conduction electron-emitting device of the present invention, a voltage is applied to the high-resistance, discontinuous-state film 4 by using the electrodes 2 and 3 to flow the current to the surface of the film 4, so that the electrons are emitting from the electron-emitting region 5.

Figure 24A:
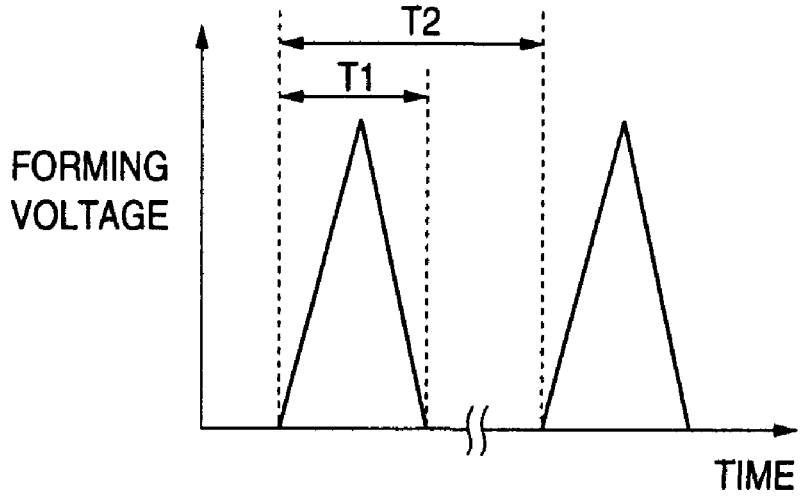
FIG. 24A and FIG. 24B are diagrams for explaining a waveform of a forming voltage used by the electron-emitting device production apparatus.
Figure 24B:
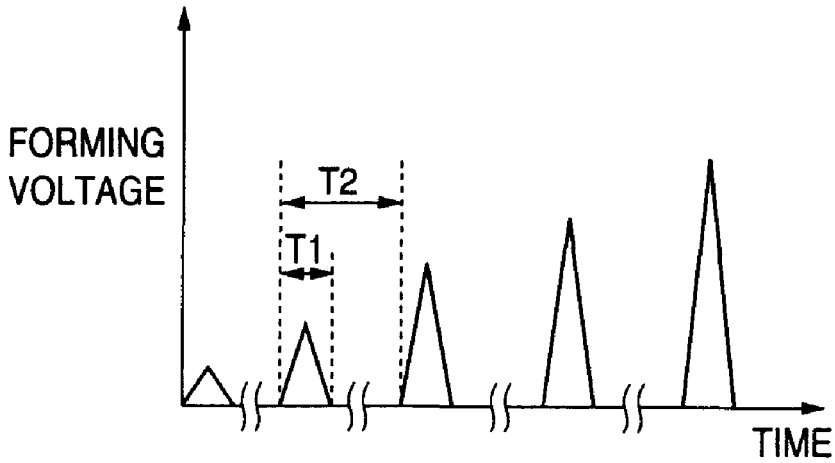

FIG. 24A and FIG. 24B show the waveform of the forming voltage used by the electron-emitting device production apparatus of the present invention.

A suitable waveform of the fuming voltage that is applied between the opposing electrodes by the production apparatus of the present invention when forming the electron-emitting region 5 is a triangular pulsed waveform. There are two types of the forming voltage waveform: (A) the peak level of all the pulses is constant with respect to the elapsed time, and (B) the peak level of the respective pulses is gradually increased with respect to the elapsed time. FIG. 24A shows the type (A) of the forming voltage waveform, and FIG. 24B shows the type (B) of the forming voltage waveform.

In FIG. 24A and FIG. 24B, "T1" indicates a pulse width of one of the pulses in the waveform, and "T2" indicates a pulse interval between two of the pulses in the waveform. The pulse width T1 ranges from 1 μs to 10 ms. The pulse interval T2 ranges from 10 μs to 100 ms.

In the type (A) of the waveform, the peak level (or the forming voltage peak) of all the triangular pulses, which is constant, is suitably determined depending on the configuration of the surface conduction electron-emitting elements. Such forming voltage is applied between the opposing electrodes 2 and 3 to the film 4 for a period in a range from several seconds to several ten minutes. The waveform of the forming voltage according to the invention is not limited to the triangular pulsed waveform of this embodiment.

In the type (B) of the waveform, the pulse width T1 and the pulse interval T2 are essentially the same as those corresponding elements in the type (A). The peak level of the respective pulses in the waveform of the type (B) is increased with respect to the elapsed time with increments of, for example, 0.1 volts.

The process of forming the electron-emitting region 5 in the conductive thin film 4 is terminated by measuring a current flowing through the film 4 when a suitable voltage (which does not locally destroy or deform the film 4) is applied between the electrodes 2 and 3 to the film. For example, the process of the forming is terminated if the current, when 0.1 V is applied, is measured and the calculated resistance exceeds the level of 1 M Ω.

After the process of the forming is performed, it is preferred that an activation process is performed to the electron-emitting region. By performing the activation process, the electron-emitting element current and the electron emission current can be remarkably improved. When performing the activation process, the substrate is placed in a vacuum container filled with an atmosphere containing gases of organic substances, and the application of a pulsed voltage to the film is repeated in the same manner as in the forming process.

After the activation process is performed, it is preferred that a stabilization process is performed to the electron-emitting region. By performing the stabilization process, the electron-emitting element current and the electron emission current can be stabilized. When performing the stabilization process, the substrate is placed in a vacuum container filled with an atmosphere containing gases of organic substances, and the decomposition pressure of the organic-substance gases is below $1\times10^{-8}$ torr, or more suitably below $1\times10^{-10}$ torr. The internal pressure of the vacuum container is in a range from $1\times10^{-6}$ torr to $1\times10^{-7}$ torr, or more suitably below $1\times10^{-8}$ torr.

Next, a description will be given of the image display apparatus of the present invention.

Figure 25:
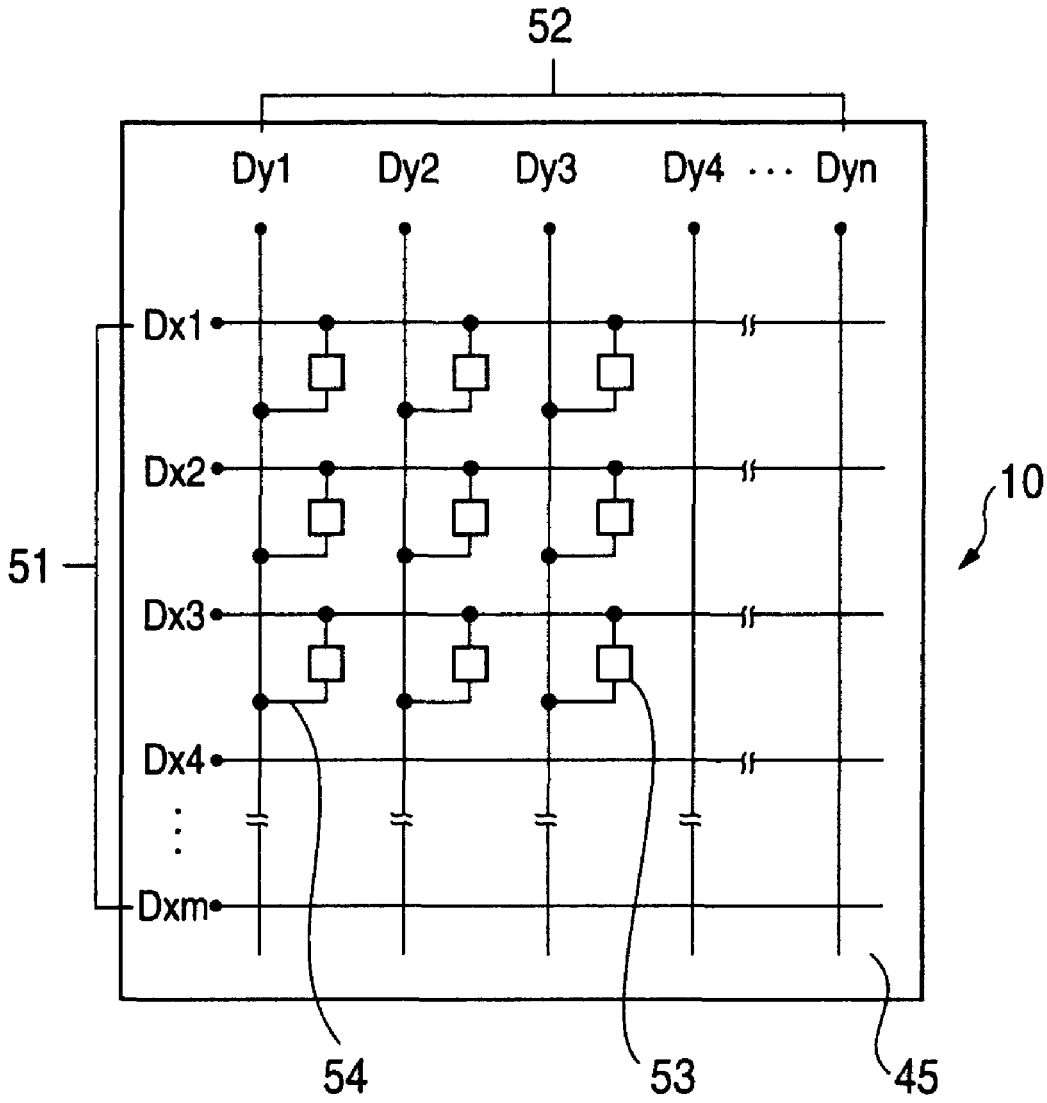
FIG. 25 is a diagram showing one embodiment of the matrix formation electron-emitting device of the invention.

FIG. 25 shows one embodiment of the matrix formation emitting-emitting device for use in the image display apparatus of the invention.

In the electron-emitting device 10 of the present embodiment, the surface conduction electron-emitting elements are arrayed in a matrix formation, and the matrix of the electron-emitting elements has "m" rows and "n" columns in two orthogonal directions. The electron-emitting elements are disposed such that the orthogonal directions of the matrix are parallel to the orthogonal directions of the sides of the substrate 45.

As shown in FIG. 25, in the electron-emitting device 10, the substrate 45, X-direction wires 51 (Dx1, Dx2, . . . , Dxm), Y-direction wires 52 (Dy1, Dy2, . . . , Dyn), surface conduction electron-emitting elements 53, and connection wires 54 are provided, where "m" and "n" are positive integers. The materials, the film thickness and the wire width are suitably selected in order to supply a substantially uniform voltage to each of the electron-emitting elements 53. The "m" X-direction wires 51 (Dx1, Dx2, . . . , Dxm) and the "n" Y-direction wires 52 (Dy1, Dy2, . . . , Dyn) are electrically isolated by an intermediate insulating layer (not shown), and they are arrayed in the matrix formation.

The intermediate insulating layer is formed entirely or in a desired region of the substrate 45 in which the X-direction wires 51 are formed. The X-direction wires 51 and the Y-direction wires 52 are pulled out to external terminals. The "m" X-direction wires 51, the "n" Y-direction wires 52 and the connection wires 54 are individually connected to the opposing electrodes (not shown) for each of the respective electron-emitting elements 53.

Figure 26:
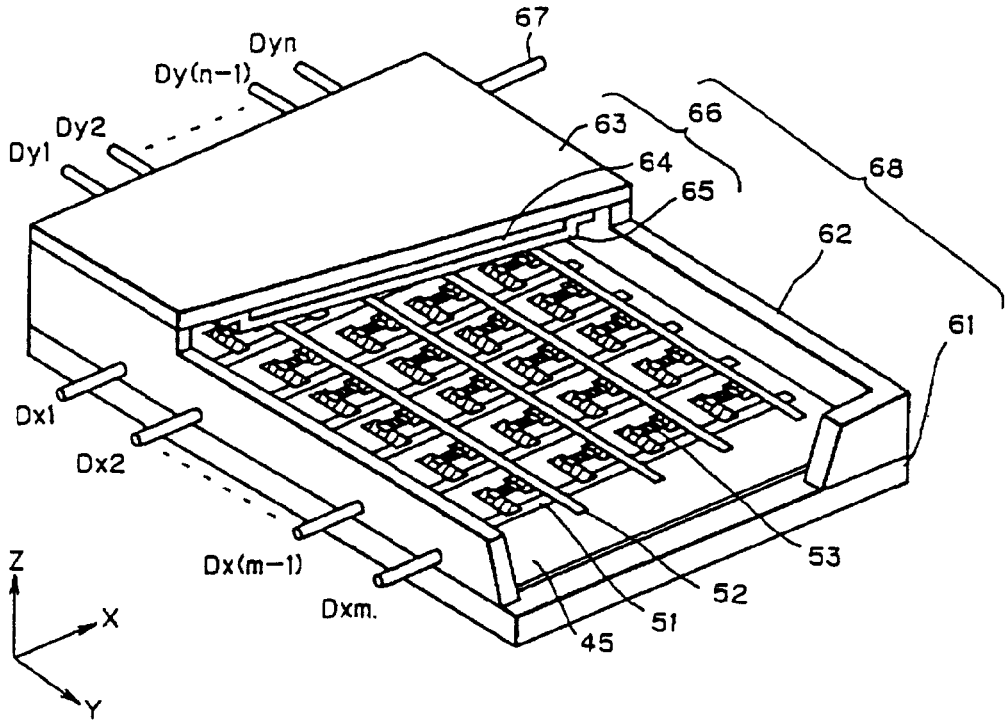
FIG. 26 is a perspective view of an image display panel of the image display apparatus in which the matrix formation electron-emitting device of FIG. 25 is provided.

FIG. 26 shows an image display panel of the image display apparatus in which the matrix formation electron-emitting device of FIG. 25 is provided.

As shown in FIG. 26, in the display panel of the present embodiment, the substrate 45, a rear plate 61, a frame 62 and a face plate 66 are provided. The electron-emitting elements 53 are disposed on the substrate 45 together with the X-direction wires 51 and the Y-direction wires 52. The substrate 45 is secured to the rear plate 61. In the face plate 66, a glass substrate 63, a fluorescent film 64 and a metal back 65 are provided, the fluorescent film 64 being attached to the internal surface of the glass substrate 63 and enclosed by the metal back 65. An enclosure 68 is formed by applying a frit glass or the like to the rear plate 61, the frame 62 and the face plate 66 and burning them in the atmosphere or nitrogen gas at temperatures ranging from 400 to 500 degrees over 10 minutes. The structure of each of the electron-emitting elements 53 is the same as that shown in FIG. 1A and FIG. 1B.

Regarding the glass substrate 63 contained in the face plate 66, it is desirable to take measures for protecting the operator against injury. Similar to the substrate 45 of the electron-emitting device, in the present embodiment, edges of the glass substrate 63 between the front surface and the side surfaces perpendicular to the front surface are chamfered for this purpose. Slanted surfaces are formed along these edges as a result of the chamfering of the edges between the front surface and the sides surfaces. Two adjacent ones of the slanted surfaces intersect each other at one of the four corners of the glass substrate 63. Further, in the present embodiment, edges of the glass substrate 63 between the back surface and the side surfaces perpendicular to the back surface are chamfered for the same purpose. Further, in the present embodiment, the two adjacent ones of the slanted surfaces are further chamfered at one of the four corners of the glass substrate 63 for the same purpose.

It is readily understood that the above-mentioned configurations of the glass substrate 63 of the face plate 66 are essentially the same as those of the substrate 1 of the electron-emitting device shown in FIG. 12A through FIG. 14.

In the display panel of FIG. 26, the enclosure 68 is formed from the face plate 66, the frame 62 and the rear plate 61. The substrate 45 is secured to the rear plate 61 for the purpose of reinforcement of the stiffness of the substrate 45. If the stiffness of the substrate 45 is adequately high, the rear plate 61 is unneeded. In such embodiment, the substrate 45 may be directly supported by the frame 62, and the enclosure 68 may be formed from the face plate 66, the frame 62 and the substrate 45.

In the present embodiment, it is difficult to attach an additional plate to the face plate 66 in order to increase the stiffness of the face plate 66 like the rear plate 61 to which the substrate 45 is secured. One solution to the above problem is that the glass substrate 63 is configured to have a thickness that is larger than the thickness of the substrate 45 of the electron-emitting device. By using such glass substrate, it is possible to increase the stiffness of the face plate 66. Another solution is that the glass substrate 63 of the face plate 66 is made of a tempered glass or a semi-tempered glass for the purpose of increasing of the stiffness of the glass substrate 63 itself.

Figure 27A:
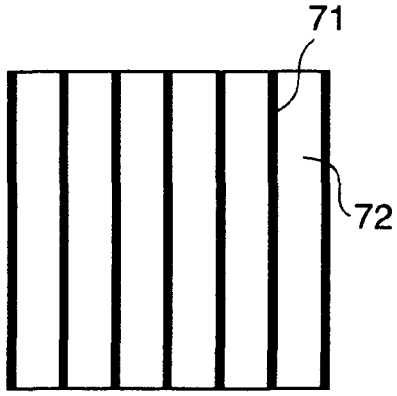
FIG. 27A and FIG. 27B are diagrams for explaining a fluorescent film in the image display panel of FIG. 26.
Figure 27B:
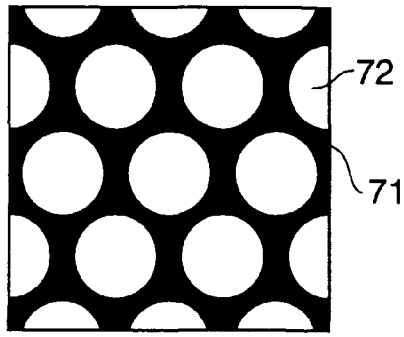

FIG. 27A and FIG. 27B are diagrams for explaining the fluorescent film 64 in the image display panel of FIG. 26.

In a case of a monochrome display, the fluorescent film 64 is made of only a florescent medium 72 only. In a case of a color display, the fluorescent film 64 is made of a black conductor 71 and the fluorescent medium 72. FIG. 27A shows a black stripe configuration of the black conductor 71 in the color-type fluorescent film 64, and FIG. 27B shows a black matrix configuration of the black conductor 71 in the color-type fluorescent film 64.

The black conductor 71 is provided in the fluorescent film 64 in order to make the mixing of the three primary colors invisible or to prevent the lowering of the contrast of an image due to reflection of external light. A suitable material of the black conductor 71 may be graphite or another conductive material having a small transmittance and a small reflectance.

In the image display apparatus of the present embodiment, the electron-emitting elements 53 and the fluorescent film 64 are positioned and arranged such that the two orthogonal directions of the matrix of the electron-emitting elements 53 are parallel to the two orthogonal directions of the black matrix of the film 64 or the directions of the black stripe of the film 64. When the former directions match with the latter directions, it is possible that the image display apparatus provide visualization of a high-quality image.

In the display panel of FIG. 26, the fluorescent film 64 is attached to the internal surface of the glass substrate 63, and the fluorescent film 64 is enclosed by the metal back 65. The metal back 65 functions to reflect a light, directed from the fluorescent medium to the metal back 65, back to the face plate 66, and serves as an electrode that supplies an electron beam acceleration voltage to the electron-emitting device. Further, the metal back 65 protects the fluorescent medium 72 against damage due to collision of negative ions produced within the enclosure 68. After the fluorescent film 64 is prepared, the metal back 65 is prepared by smoothing the internal side surfaces of the fluorescent film 64 (which is called filming) and depositing the metallic substance (e.g., aluminum) on the smoothed surfaces through a vapor deposition method.

Figure 28:
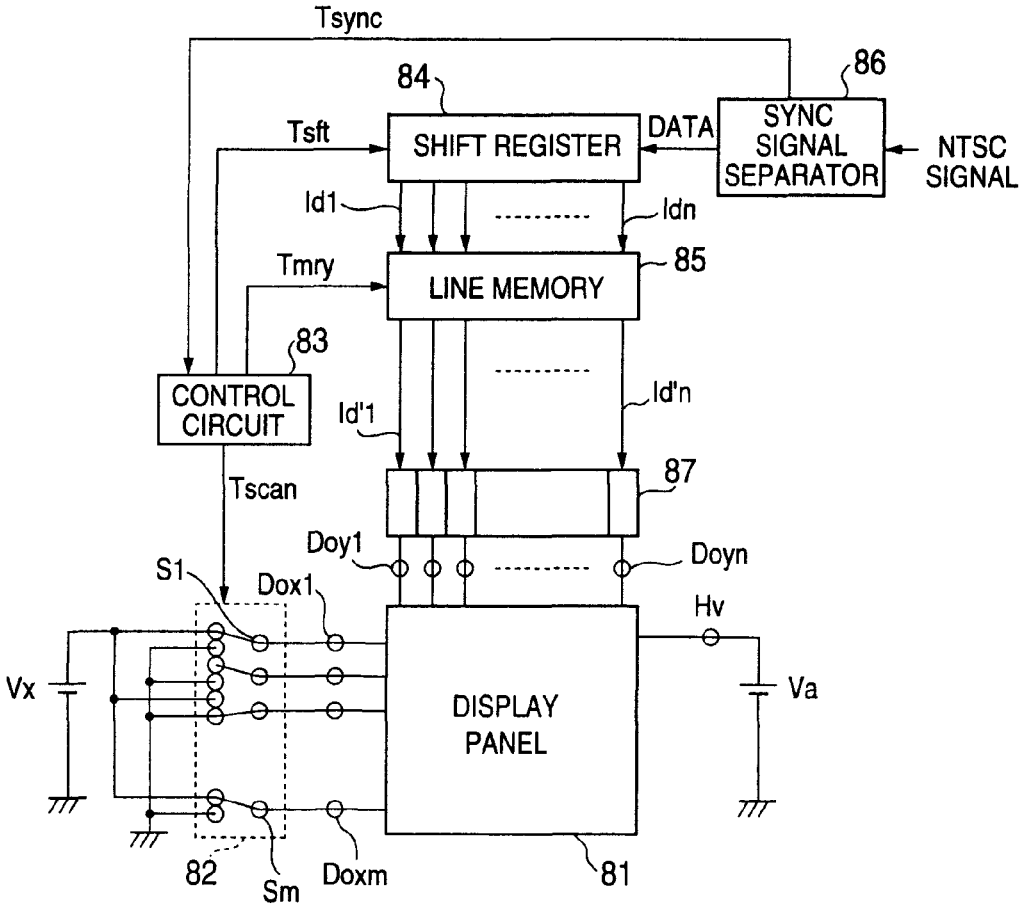
FIG. 28 is a block diagram of a display control circuit which controls the image display panel of FIG. 26 in accordance with an NTSC signal.

FIG. 28 shows a display control circuit that controls the image display panel of FIG. 26 in accordance with an NTSC signal.

As shown in FIG. 28, in the image display apparatus of the present embodiment, there are provided an image display panel 81, a scanning circuit 82, a control circuit 83, a shift register 84, a line memory 85, a sync signal separator circuit 86, a modulation signal generator 87, a dc voltage source Vx, and a dc voltage source Va.

In the image display apparatus of the present embodiment, the display panel 81 includes "m" terminals Dox1 through Doxm, "n" terminals Doy1 through Doyn, and a high-voltage terminal Hv, where "m" and "n" are positive integers. The display panel 81 is connected through these terminals to external circuits. A scanning signal is supplied from the dc voltage source Vx to the "m" terminals Dox1 through Doxm of the display panel 81 through "m" switching devices S1 through Sm of the scanning circuit 82 (indicated by the dotted line in FIG. 28). The "m" rows of "n" surface conduction electron-emitting elements in the display panel 81 are sequentially selected and driven by the scanning signal.

The modulation signal generator 87 supplies a modulation signal to the "n" terminals Doy1 through Doyn of the display panel 81, and the electron beams, emitted from the individual electron-emitting elements of the selected one of the "m"

rows in the display panel 81, are controlled in accordance with the modulation signal. The dc voltage source Va supplies a dc high voltage (e.g., 10 kV) to the high-voltage terminal Hv of the display panel 81 so that an electric energy needed to excite the fluorescent medium is given to the electron beams emitted by the surface conduction electron-emitting elements of the display panel 81.

The scanning circuit 82 is provided with the "m" switching devices S1 through Sm. The switching devices S1-Sm are respectively connected to the terminals Dox1-Doxm of the display panel 81. A selected one of the source voltage (the output voltage of the voltage source Vx) and the ground voltage (0 V) is supplied from each of the switching devices S1-Sm to a corresponding one of the terminals Dox1-Doxm of the display panel 81. The control circuit 83 sends a control signal Tscan to the scanning circuit 82, and the ON/OFF state of the switching devices S1-Sm of the scanning circuit 82 is controlled by the control signal Tscan.

The NTSC (National Television Standards Committee) signal is externally transmitted to the input of the sync signal separator circuit 86. The sync signal separator circuit 86 separates the NTSC signal into a sync signal Tsync and an intensity signal Data. It is commonly known that the sync signal, derived from the NTSC signal, is comprised of the horizontal sync signal and a vertical sync signal. However, for the sake of convenience, the sync signal in the present embodiment is indicated by "Tsync". The sync signal Tsync is sent to the control circuit 83. The intensity signal Data, derived from the NTSC signal, is sent to the shift register 84.

The control circuit 83 generates the control signal Tscan and control signals Tsft and Tmry in response to the sync signal Tsync received from the sync signal separator circuit 86. The control circuit 83 controls the respective elements of the image display apparatus by transmitting the control signal Tscan, the control signal Tsft and the control signal Tmry to the scanning circuit 82, the shift register 84 and the line memory 85, respectively.

The shift register 84 provides serial-to-parallel conversion of the intensity signal Data received from the separator circuit 86. The shift register 84 is operated in accordance with the control signal Tsft and supplies "n" parallel data signals Id1-Idn (which corresponds to one scanning line of a reproduced image) to the line memory 85.

The line memory 85 temporarily stores the "n" parallel data signal Id1-Idn from the shift register 84 in accordance with the control signal Tmry, and supplies the stored parallel data signal Id1'-Idn' to the modulation signal generator 87. The modulation signal generator 87 supplies the modulation signal to the "n" terminals Doy1 through Doyn of the display panel 81 in accordance with the data signal Id1'-Idn' received from the line memory 85. Therefore, the electron beams, emitted from the individual electron-emitting elements of the selected one of the "m" rows in the display panel 81, are controlled in accordance with the modulation signal.

In the above-described embodiment, the NTSC signal is provided to the image display apparatus. However, the present invention is not limited to this embodiment. Alternatively, a PAL signal, a SECAM signal or a MUSE signal (such as a high-definition TV signal may be provided to the image display apparatus.

Figure 29:
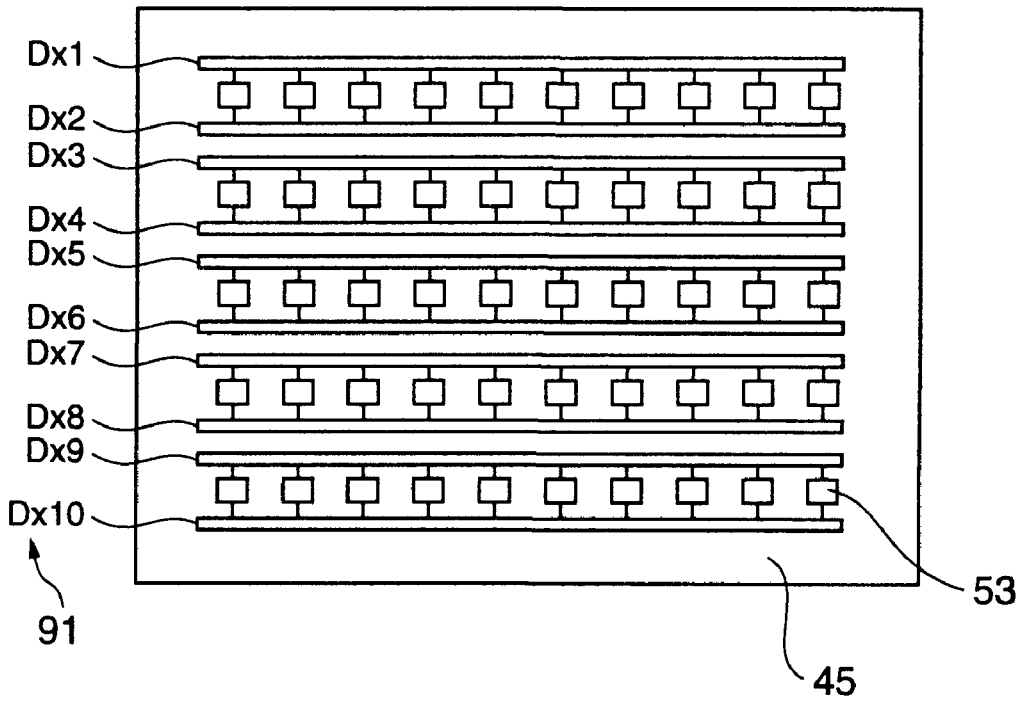
FIG. 29 is a diagram showing one embodiment of the ladder formation electron-emitting device of the invention.
Figure 30:
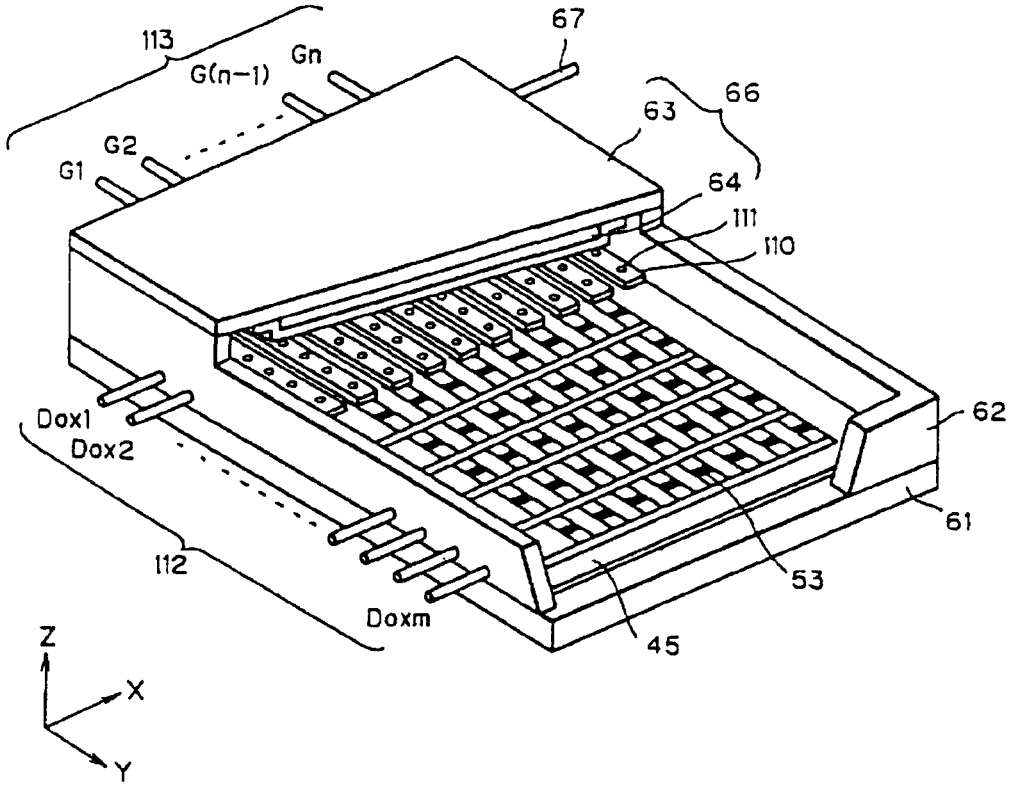
FIG. 30 is a perspective view of an image display panel of the image display apparatus in which the ladder formation electron-emitting device of FIG. 29 is provided.
Figure 31:
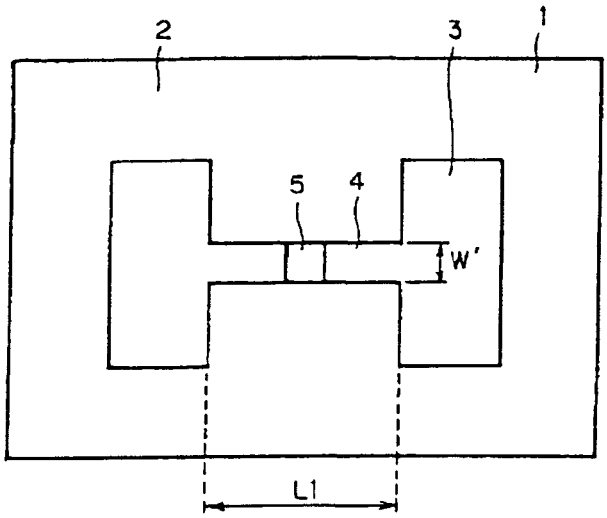
FIG. 31 PRIOR ART
FIG. 31 is a diagram showing a conventional electron-emitting device.

Next, FIG. 29 shows one embodiment of the ladder formation electron-emitting device of the invention. FIG. 30 shows an image display panel of the image display apparatus in which the ladder formation electron-emitting device of the invention is provided.

In the electron-emitting device of the present embodiment, the surface conduction electron-emitting elements are arrayed in a ladder formation, and the matrix of the electron-emitting elements has "m" rows and "n" columns in two orthogonal directions. In the example of FIG. 29, m=5 and n=10. The electron-emitting elements are disposed such that the orthogonal directions of the matrix are parallel to the orthogonal directions of the sides of the substrate 45.

As shown in FIG. 29, in the ladder formation electron-emitting device, the substrate 45, ten common wires 91 (Dx1, Dx2, . . . , Dx10), 5×10 surface conduction electron-emitting elements 53, and individual connection wires are provided. The materials, the film thickness and the wire width are suitably selected in order to supply a substantially uniform voltage to each of the electron-emitting elements 53. The common wires 91 are pulled out to external terminals. The common wires 91 and the connection wires are individually connected to the opposing electrodes (not shown) for each of the respective electron-emitting elements 53.

As shown in FIG. 30, in the display panel of the present embodiment, the substrate 45, the rear plate 61, the frame 62, the face plate 66, and grid electrodes 110 are provided. In FIG. 30, the elements which are essentially the same as corresponding elements in FIG. 26 are designated by the same reference numerals, and a description thereof will be omitted.

In the display panel of FIG. 30, a set of openings 111 are provided in each of the grid electrodes 110, and the electrons emitted from the electron-emitting elements 53 pass through these openings 111 to the face plate 66. External terminals 112 (Dox1-Doxm) are provided outside the display panel and connected to the common wires 91. External terminals 113 (G1-Gn) are provided outside the display panel and connected to the grid electrodes 111. The structure of each of the electron-emitting elements 53 is the same as that shown in FIG. 1A and FIG. 1B.

Next, a description will be given of another embodiment of the image display apparatus of the present invention.

In the present embodiment, the electron-emitting device is produced by the production apparatus that is configured such that the effective area in which the discharge head is capable of discharging the drops of the source material of the conductive thin film to the substrate is larger than the entire region that covers surface conduction first electron-emitting elements on the substrate. Namely, in the electron-emitting device of this embodiment, a plurality of surface conduction second electron-emitting elements are disposed outside the region of the first electron-emitting elements on the substrate by discharging the drops to the substrate. The second electron-emitting elements provide a device identification pattern that is essentially the same as that of FIG. 21A. The image display apparatus of this embodiment is configured to visualize a device identification image (e.g., a production lot no.) in response to electrons emitted from the device identification pattern of the electron-emitting device.

Figure 23B:
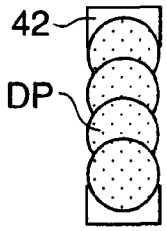
FIG. 23A and FIG. 23B are diagrams for explaining another embodiment of the substrate that is appropriate for the electron-emitting device of the invention.
Figure 23A:
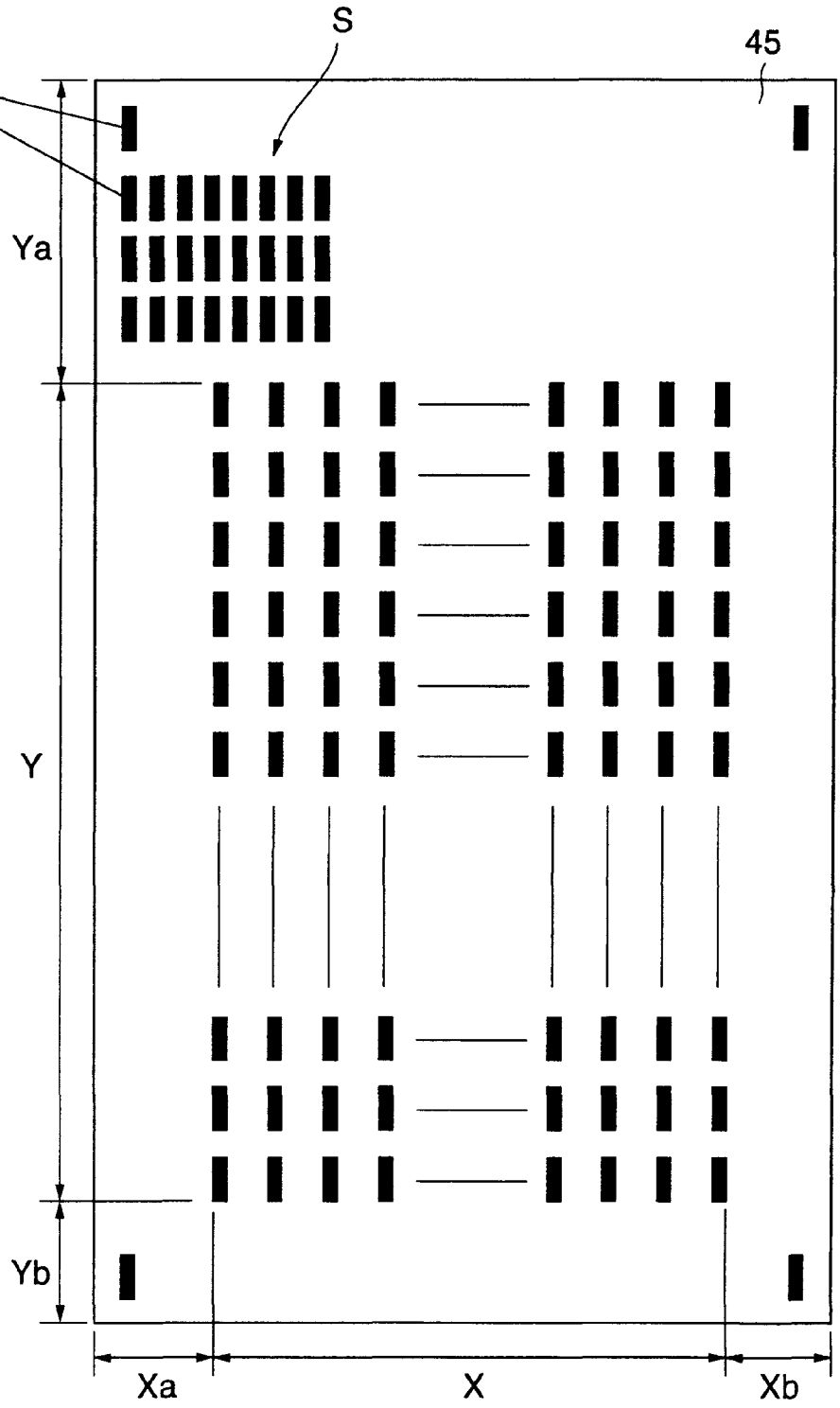

FIG. 23A and FIG. 23B show an embodiment of the substrate that is appropriate for the electron-emitting device provided in the image display apparatus of the present embodiment.

As shown in FIG. 23A, in a region "Ya" of the substrate 45, which is located outside a region "Y" that covers the first electron-emitting elements on the substrate 45, a plurality of surface conduction second electron-emitting elements "S" are formed. FIG. 23B shows a dot pattern of one of the second electron-emitting elements "S". The second electron-emitting elements "S" provides a device identification pattern (e.g., a production lot no.) that is assigned for a specific one of the individual electron-emitting devices after the manufacture.

Similar to the previous embodiment, in the electron-emitting device of the present embodiment, the first electron-emitting elements are disposed in the conductive thin film by discharging the drops to the substrate 45, each first electron-emitting element spaced apart from the opposing electrodes of one of the electrode pairs.

In the image display apparatus of the present embodiment, the face plate 66 is provided to face the electron-emitting device described above and includes the fluorescent medium 72 that visualizes a device identification image in response to electrons emitted from the device identification pattern "S" of the electron-emitting device. The device identification image, which is displayed on the face plate 66 of the display panel, may be of a different color from the color of an image visualized in response to electrons emitted from the first electron-emitting elements of the electron-emitting device. Alternatively, the image display apparatus of the present embodiment may be configured to transmit an image signal indicating the device identification image to another system.

Accordingly, the image display apparatus of the present embodiment is effective in providing easy identification of the electron-emitting device of the image display apparatus after the manufacture.

The present invention is not limited to the above-described embodiments, and variations and modifications may be made without departing from the scope of the present invention.

Further, the present invention is based on Japanese priority application No. 2000-51102, filed on Feb. 28, 2000, and Japanese priority application No. 2000-358111, filed on Nov. 24, 2000, the entire contents of which are hereby incorporated by reference.

What is claimed is:

1. A pattern substrate comprising:

a substrate; and a conductive pattern disposed on the substrate wherein said conductive pattern is formed to include two or more overlapping circular patterns by discharging liquid drops including particles of a conductive material and formed in a line-shaped pattern, wherein a plurality of bar-shaped patterns are disposed outside a region of the conductive pattern on the substrate, the bar-shaped patterns being formed by discharging liquid drops with the same liquid to form said conductive pattern, wherein said substrate has a smoothness that can obtain a clear dot pattern, and wherein the substrate has a first surface, side surfaces perpendicular to the first surface, and edges between the side surfaces and the first surface, the conductive pattern is formed on the first surface, the edges are chamfered, and the chamfered surface has a surface roughness ranging from 0.5 μm to 5 μm.

2. The pattern substrate of claim 1, wherein the substrate has a back surface, side surfaces perpendicular to the back surface, and edges between the side surfaces and the back surface, and the edges are chamfered, and said chamfered surface having a surface roughness ranging from 0.5 μm to 5 μm.

3. The pattern substrate of claim 1, wherein the edges are chamfered to form slanted surfaces, two adjacent ones of the slanted surfaces intersecting each other at one of four corners of the substrate and being further chamfered at said corner, and said chamfered surfaces have a surface roughness ranging from 0.5 μm to 5 μm.

4. The pattern substrate of claim 1, wherein the substrate has a front surface, side surfaces perpendicular to the front surface, and edges between the side surfaces and the front surface, the edges being chamfered to form slanted surfaces, conductive patterns are formed on the front surface, and the slanted surfaces have a surface roughness that is larger than a surface roughness of the front surface and said surface roughness ranging from 0.5 μm to 5 μm.

5. A pattern substrate comprising:

a substrate; and a conductive pattern disposed on the substrate wherein said conductive pattern is formed to include two or more overlapping circular patterns and formed in a line-shaped pattern, wherein a substrate identification pattern is disposed outside a region of the conductive pattern on the substrate by discharging liquid drops including particles of a conductive material to the substrate, wherein the substrate has a smoothness that can obtain a clear dot pattern, and wherein the substrate has a first surface, side surfaces perpendicular to the first surface, and edges between the side surfaces and the first surface, the conductive pattern is formed on the first surface, the edges are chamfered, and the chamfered surface has a surface roughness ranging from 0.5 μm to 5 μm.

6. The pattern substrate according to claim 5, wherein the substrate has a back surface, side surfaces perpendicular to the back surface, and edges between the side surfaces and the back surface, and the edges are chamfered, and said chamfered surface having a surface roughness ranging from 0.5 μm to 5 μm.

7. The pattern substrate according to claim 5, wherein the substrate has a front surface, side surfaces perpendicular to the front surface, and edges between the side surfaces and the front surface, the edges being chamfered to form slanted surfaces, conductive patterns are formed on the front surface, and the slanted surfaces have a surface roughness that is larger than a surface roughness of the front surface and said surface roughness ranging from 0.5 μm to 5 μm.

8. A pattern substrate comprising:

a substrate; and a conductive pattern disposed on the substrate wherein said conductive pattern is formed to include two or more mutually overlapping circular patterns and formed in a line-shaped pattern, and wherein a substrate identification pattern is disposed outside a region of the conductive pattern on the substrate by discharging liquid drops including particles of a conductive material to the substrate, and wherein the substrate has a smoothness that can obtain a clear dot pattern, and wherein the substrate has a first surface, side surfaces perpendicular to the first surface, and edges between the side surfaces and the first surface, and the edges are chamfered to form slanted surfaces, two adjacent ones of the slanted surfaces intersecting each other at one of four corners of the substrate and being further chamfered at said corner, and the chamfered surfaces have a surface roughness ranging from 0.5 μm to 5 μm.

9. The pattern substrate according to claim 8, wherein the substrate has a back surface, side surfaces perpendicular to the back surface, and edges between the side surfaces and the back surface, the edges are chamfered, and the chamfered surface has a surface roughness ranging from 0.5 μm to 5 μm.

10. The pattern substrate according to claim 8, wherein the substrate has a front surface, side surfaces perpendicular to the front surface, and edges between the side surfaces and the front surface, the edges being chamfered to form slanted surfaces, conductive patterns are formed on the front surface, and the slanted surfaces have a surface roughness that is larger than a surface roughness of the front surface, said surface roughness ranging from 0.5 μm to 5 μm.

* * * * *

UNITED STATES PATENT AND TRADEMARK OFFICE

CERTIFICATE OF CORRECTION

PATENT NO. : 7,884,537 B2
APPLICATION NO. : 12/029967
DATED : February 8, 2011
INVENTOR(S) : Takuro Sekiya It is certified that error appears in the above-identified patent and that said Letters Patent is hereby corrected as shown below:

Replace the Related U.S. Application Data section on the Title page of the patent, with the following:

--(63) Continuation of application No. 11/238,428 filed on September 29, 2005, now Patent No. 7,355,335, which is a continuation of application No. 09/793,249 filed on February 26, 2001, now Patent No. 6,992,433--

Signed and Sealed this
Thirty-first Day of May, 2011

David J. Kappos

David J. Kappos
*Director of the United States Patent and Trademark Office*